US011685484B1

(12) United States Patent
Hardy-Pare et al.

(10) Patent No.: US 11,685,484 B1
(45) Date of Patent: Jun. 27, 2023

(54) BARRIER STRUCTURE FOR A WATERCRAFT AND WATERCRAFT HAVING SAME

(71) Applicant: BOMBARDIER RECREATIONAL PRODUCTS INC., Valcourt (CA)

(72) Inventors: Julien Hardy-Pare, Shefford (CA); Michel Bourret, Drummondville (CA); Marc-Etienne Bessette, Granby (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 140 days.

(21) Appl. No.: 17/164,195

(22) Filed: Feb. 1, 2021

Related U.S. Application Data

(60) Provisional application No. 62/968,303, filed on Jan. 31, 2020.

(51) Int. Cl.
*B63B 35/34* (2006.01)
*B63B 17/04* (2006.01)
*B63B 3/08* (2006.01)

(52) U.S. Cl.
CPC ..... *B63B 35/34* (2013.01); *B63B 3/08* (2013.01); *B63B 17/04* (2013.01); *B63B 2003/085* (2013.01)

(58) Field of Classification Search
CPC ..... B63B 35/00; B63B 35/34; B63B 3/00; B63B 3/08; B63B 17/00; B63B 17/04
USPC ..... 114/343, 364
See application file for complete search history.

(56) References Cited

U.S. PATENT DOCUMENTS 10,745,085 B2 * 8/2020 McGarian ..... B63B 17/04
2019/0202528 A1 * 7/2019 McGarian ..... B63B 17/04

OTHER PUBLICATIONS

Evinrude E-TEC Performance Report, Manitou Pontoon Boats, 2019 Manitou 25 LT SHP Dual, Bulletin No. 1305, Aug. 6, 2018, 1 page, USA.
Evinrude E-TEC Performance Report, Manitou Pontoon Boats, 2018 Manitou 23 Encore SHP, Jul. 30, 2017, 1 page, USA.

* cited by examiner

*Primary Examiner* — Lars A Olson
(74) *Attorney, Agent, or Firm* — BCF LLP

(57) ABSTRACT

A watercraft includes a deck, a hull supporting the deck, and a barrier structure. The barrier structure includes: a frame connected to at least one of the deck and the hull and at least partially surrounding a portion of the deck; and a pliable sheet wall connected to the frame. The frame includes an upper portion including a rail for grabbing by a user's hand; and a lower portion connected to the at least one of the deck and the hull. The lower portion and the upper portion are connected to one another. The pliable sheet wall is stretched across at least a portion of the frame so as to extend between the upper and lower portions of the frame. A barrier structure is also contemplated.

20 Claims, 26 Drawing Sheets

BARRIER STRUCTURE FOR A WATERCRAFT AND WATERCRAFT HAVING SAME

CROSS-REFERENCE

The present application claims priority from U.S. Provisional Patent Application No. 62/968,303, filed Jan. 31, 2020, the entirety of which is incorporated herein by reference.

FIELD OF TECHNOLOGY

The present technology relates to watercraft having barrier structures.

BACKGROUND

Some recreational watercraft such as pontoon boats include a barrier structure (or "wall") that surrounds the periphery of the deck of the watercraft. These structures notably act as rails that can be held onto by users aboard the watercraft, in addition to preventing users and objects from inadvertently falling off the deck.

However, conventional barrier structures have various limitations. For instance, one example of a barrier structure includes molded fiberglass sections which, while aesthetically pleasing, are complex and expensive to produce and therefore generally limited to higher end models of watercraft. Moreover, such fiberglass sections are not easily adaptable to a modular construction of a watercraft where the length thereof can vary depending on the model produced, as a different sized fiberglass barrier structure would be required for each different length model. In other cases, a barrier structure can include a tubular metal frame outfitted with sheet metal panels, which although less expensive than fiberglass barrier structures, can still be relatively expensive to produce and, in addition, complicated to install and replace.

In view of the foregoing, there is a need for a barrier structure for a watercraft that addresses at least some of these drawbacks.

SUMMARY

It is an object of the present technology to ameliorate at least some of the inconveniences present in the prior art.

According to an aspect of the present technology, there is provided a watercraft. The watercraft includes: a deck; a hull supporting the deck; and a barrier structure. The barrier structure includes a frame connected to at least one of the deck and the hull and at least partially surrounding a portion of the deck. The frame includes an upper portion including a rail for grabbing by a user's hand, and a lower portion connected to the at least one of the deck and the hull. The lower portion and the upper portion are connected to one another. The barrier structure also includes a pliable sheet wall connected to the frame. The pliable sheet wall is stretched across at least a portion of the frame so as to extend between the upper and lower portions of the frame.

In some embodiments, the pliable sheet wall includes: at least one pliable sheet panel having an upper edge and a lower edge; and an anchor extending at least partially along one of the upper edge and the lower edge of the at least one pliable sheet panel, the anchor connecting the at least one pliable sheet panel to a corresponding one of the upper and lower portions of the frame.

In some embodiments, the one of the upper edge and the lower edge is the upper edge, and the anchor connects the at least one pliable sheet panel to the upper portion of the frame.

In some embodiments, one of the frame and the anchor defines a channel, and an other one of the frame and the anchor includes an interlocking member that is at least partially received in the channel so as to connect the one of the upper edge and the lower edge of the at least one pliable sheet panel to the frame.

In some embodiments, the one of the frame and the anchor is the frame such that the frame defines the channel and the anchor includes the interlocking member.

In some embodiments, the rail of the frame defines the channel.

In some embodiments, the pliable sheet wall also includes at least one attachment portion disposed along an other one of the upper edge and the lower edge of the at least one pliable sheet panel, the at least one attachment portion connecting the other one of the upper edge and the lower edge of the at least one pliable sheet panel to a corresponding one of the upper and lower portions of the frame.

In some embodiments, the at least one attachment portion includes a hook-and-loop fastener.

In some embodiments, a cross-sectional profile of the interlocking member is generally V-shaped.

In some embodiments, a cross-sectional profile of the interlocking member includes a tip and two side arms converging at the tip.

In some embodiments, in a cross-section of the barrier structure taken perpendicular to the at least one pliable sheet panel, the interlocking member extends from the other one of the frame and the anchor such that the tip of the interlocking member points in a direction generally perpendicular to the at least one pliable sheet panel.

In some embodiments, the one of the frame and the anchor includes: a first channel wall; a second channel wall opposite the first channel wall; and a third channel wall extending between the first and second channel walls. The channel is defined between the first, second and third channel walls. The channel has an enlarged section and a constricted section, whereby a spacing between the first and second channel walls is greater at the enlarged section than at the constricted section. The enlarged section of the channel is closer to the third channel wall than the constricted section. The interlocking member includes: an engaging portion that is inserted into the enlarged section of the channel; and a restricting portion that is disposed in the constricted section of the channel, the restricting portion being sized and shaped to limit rotation of the interlocking member within the constricted section of the channel.

In some embodiments, the restricting portion has two opposite surfaces that are in a snug fit against corresponding surfaces of the first and second channel walls.

In some embodiments, the channel extends along a laterally-outward side of the rail.

In some embodiments, at least one of the at least one pliable sheet panel is made of fabric.

In some embodiments, the at least one pliable sheet panel includes a first pliable sheet panel and a second pliable sheet panel. The first pliable sheet panel is made of fabric and the second pliable sheet panel is made of a polymeric material.

In some embodiments, the anchor is made of an elastomeric material.

In some embodiments, the lower portion of the frame includes: at least one lower railing extending generally parallel to an upper surface of the deck; and at least one lower frame connector connected between the at least one lower railing and the hull, the at least one lower frame connector extending downwardly from the at least one lower railing.

In some embodiments, the lower edge of the at least one pliable sheet panel at least partially wraps around the at least one lower railing.

In some embodiments, the lower portion of the frame includes: at least one lower railing extending generally parallel to an upper surface of the deck, the at least one lower railing defining an anchor mounting channel; and at least one lower anchor interlocked with the at least one lower railing via the anchor mounting channel, the at least one attachment portion of the pliable sheet wall being secured to the at least one lower anchor.

In some embodiments, the hull includes an outer shell and a plurality of inner bracing members at least partially enclosed within the outer shell, the inner bracing members being configured to reinforce the outer shell; and the at least one lower frame connector is connected to at least one corresponding inner bracing member of the plurality of inner bracing members.

In some embodiments, the frame also includes a plurality of support members extending between the upper and lower portions of the frame, the support members extending generally upwardly and forwardly from the lower portion to the upper portion of the frame.

According to another aspect of the present technology, there is provided a barrier structure for a watercraft. The barrier structure includes a frame configured to be connected to at least one of a deck and a hull of the watercraft and configured to at least partially surround a portion of the deck. The frame includes an upper portion including a rail for grabbing by a user's hand, and a lower portion configured to be connected to the at least one of the deck and the hull of the watercraft. The lower portion and the upper portion are connected to one another. The barrier structure also includes a pliable sheet wall connected to the frame. The pliable sheet wall is stretched across at least a portion of the frame and so as to extend between the upper and lower portions of the frame.

In some embodiments, the pliable sheet wall includes at least one pliable sheet panel having an upper edge and a lower edge, and an anchor extending at least partially along one of the upper edge and the lower edge of the at least one pliable sheet panel, the anchor connecting the at least one pliable sheet panel to a corresponding one of the upper and lower portions of the frame.

In some embodiments, the one of the upper edge and the lower edge is the upper edge, and the anchor connects the at least one pliable sheet panel to the upper portion of the frame.

In some embodiments, one of the frame and the anchor defines a channel and an other one of the frame and the anchor includes an interlocking member that is at least partially received in the channel so as to connect the one of the upper edge and the lower edge of the at least one pliable sheet panel to the frame.

In some embodiments, the one of the frame and the anchor is the frame such that the frame defines the channel and the anchor includes the interlocking member.

In some embodiments, the rail of the frame defines the channel.

In some embodiments, the pliable sheet wall also includes at least one attachment portion disposed along an other one of the upper edge and the lower edge of the at least one pliable sheet panel, the attachment portion connecting the other one of the upper edge and the lower edge of the at least one pliable sheet panel to a corresponding one of the upper and lower portions of the frame.

In some embodiments, the at least one attachment portion includes a hook-and-loop fastener.

In some embodiments, a cross-sectional profile of the interlocking member is generally V-shaped.

In some embodiments, a cross-sectional profile of the interlocking member includes a tip and two side arms converging at the tip.

In some embodiments, in a cross-section of the barrier structure taken perpendicular to the at least one pliable sheet panel, the interlocking member extends from the other one of the frame and the anchor such that the tip of the interlocking member points in a direction generally perpendicular to the at least one pliable sheet panel.

In some embodiments, the one of the frame and the anchor includes: a first channel wall; a second channel wall opposite the first channel wall; and a third channel wall extending between the first and second channel walls. The channel is defined between the first, second and third channel walls. The channel has an enlarged section and a constricted section, whereby a spacing between the first and second channel walls is greater at the enlarged section than at the constricted section. The enlarged section of the channel is closer to the third channel wall than the constricted section. The interlocking member includes an engaging portion that is inserted into the enlarged section of the channel, and a restricting portion that is disposed in the constricted section of the channel, the restricting portion being sized and shaped to limit rotation of the interlocking member within the constricted section of the channel.

In some embodiments, the restricting portion has two opposite surfaces that are in a snug fit against corresponding surfaces of the first and second channel walls.

In some embodiments, the channel extends along a laterally-outward side of the rail.

In some embodiments, at least one of the at least one pliable sheet panel is made of fabric.

In some embodiments, the at least one pliable sheet panel includes a first pliable sheet panel and a second sheet panel. The first pliable sheet panel is made of fabric and the second pliable sheet panel is made of a polymeric material.

In some embodiments, the anchor is made of an elastomeric material.

In some embodiments, the lower portion of the frame includes: at least one lower railing configured to extend generally parallel to an upper surface of the deck; and at least one lower frame connector configured to be connected between the at least one lower railing and the hull, the at least one lower frame connector extending downwardly from the at least one lower railing.

In some embodiments, the lower edge of the at least one pliable sheet panel at least partially wraps around the at least one lower railing.

In some embodiments, the lower portion of the frame includes: at least one lower railing extending generally parallel to an upper surface of the deck, the at least one lower railing defining an anchor mounting channel; and at least one lower anchor interlocked with the at least one lower railing via the anchor mounting channel, the at least one attachment portion of the pliable sheet wall being secured to the at least one lower anchor.

In some embodiments, the frame also includes a plurality of support members extending between the upper and lower portions of the frame, the support members extending generally upwardly and forwardly from the lower portion to the upper portion of the frame.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
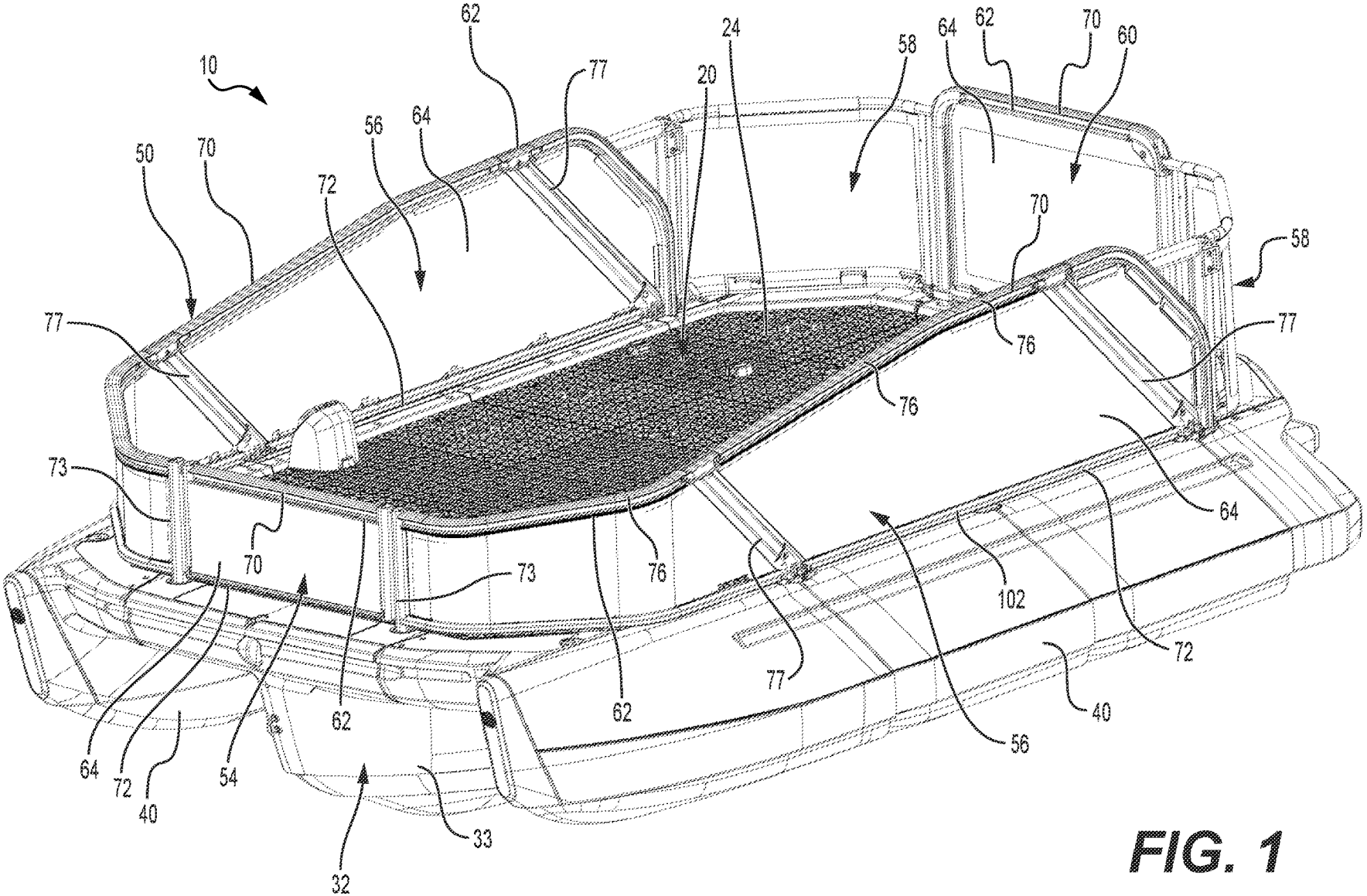
FIG. 1 is a perspective view, taken from a top front left side, of a pontoon boat in accordance with an embodiment of the present technology.
Figure 2:
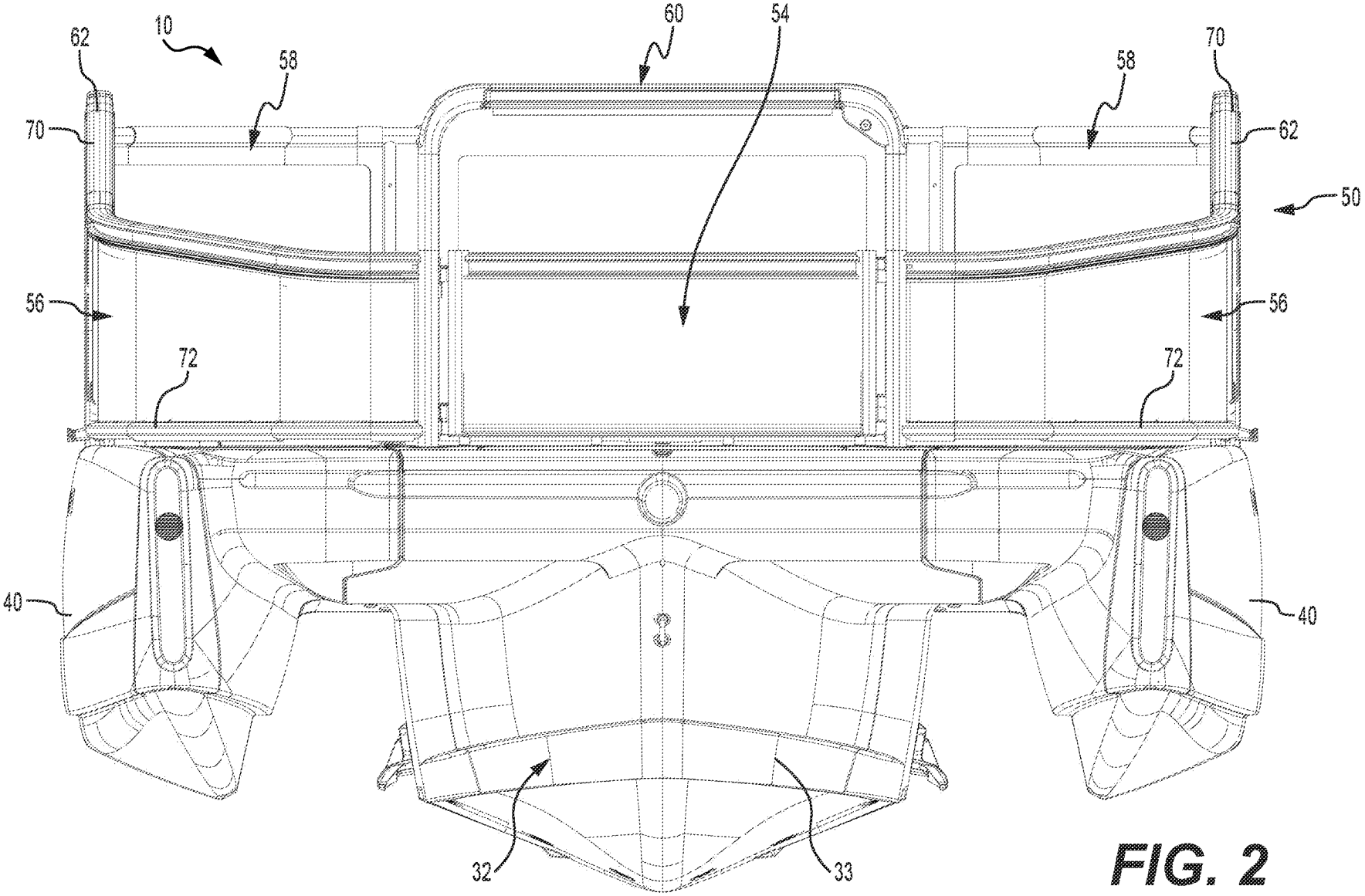
FIG. 2 is a front elevation view of the pontoon boat of FIG. 1.

A watercraft 10 in accordance with one embodiment of the present technology is shown in FIGS. 1 to 4. The following description relates to one example of a watercraft 10, notably a pontoon boat 10. Those of ordinary skill in the art will recognize that there are other known types of watercrafts incorporating different designs and that the present technology would encompass these other watercrafts.

The boat 10 has a deck 20 and a hull 32 supporting the deck 20. In this embodiment, the hull 32 includes three separate laterally-adjacent portions that are connected to one another to form the hull 32. Notably, the hull 32 has a central portion 33 and left and right lateral portions 40. These different hull portions could be considered separate hulls in some cases and thus the boat 10 may be referred to as a multihull watercraft in some cases. Nevertheless, it is contemplated that the hull 32 may constitute a single integral portion in other embodiments.

The deck 20 extends above the hull 32 and is supported thereby. The deck 20 has an upper surface 24 for supporting occupants, as well as accessories and accommodations of the boat 10 (e.g., seating, command console, etc.). In this embodiment, as best seen in FIG. 1, the deck 20 includes a plurality of tiles 22 which are configured for attachment of accessories thereto. The tiles 22 form a portion of the upper surface 24 of the deck 20. A more detailed description of the configuration of the tiles 22 and the manner in which they are used for attachment of accessories can be found in U.S. patent application Ser. No. 16/887,481, filed May 29, 2020, which is incorporated herein by reference.

It is contemplated that the deck 20 could have a different construction than that provided by the tiles 22. For instance, the deck 20 could have a more conventional construction such as including a metallic frame and an overlying flooring layer, such as wooden panels or plywood. It is further contemplated that the deck 20 could include multiple levels and/or seating or other accessories integrated therein.

In this embodiment, the hull 32 and the deck 20 of the boat 10 have a modular construction. Notably, the hull 32 includes various modular units that are connected to one another to form the hull 32. In particular, the modular units of the hull 32 are longitudinally-adjacent to one another and therefore hulls of different sizes can be assembled depending on how many modular units are connected to one another. Similarly, the deck 20 is modular due to its construction by the tiles 22. Therefore, as will be understood, the boat 10 can have different lengths depending on the modular construction the deck 20 and the hull 32. The modularity of the hull 32 is described in greater detail in U.S. patent application Ser. No. 17/038,662, filed on Sep. 30, 2020, and in U.S. patent application Ser. No. 17/039,625, filed on Sep. 30, 2020, each of which is incorporated herein by reference.

The boat 10 is propelled by a jet propulsion system 52 (shown in part in FIG. 3) powered by a motor (not shown). The jet propulsion system 52 has a steering nozzle 53 used for steering the boat 10. A handlebar (not shown) is operatively connected to the steering nozzle 53. A throttle lever (not shown) is operatively connected to the motor for controlling operation of the motor. The handlebar and the throttle lever are located on a command console provided on the deck 20. The command console is not shown in the figures in order to properly show the upper surface 24 of the deck 20. It is contemplated that other propulsion systems, such as a stem drive or a marine outboard engine, may be used to propel the boat 10. It is also contemplated that the handlebar could be replaced by a steering wheel and that the steering nozzle 53 could be replaced by an outdrive or one or more rudders.

Figure 3:
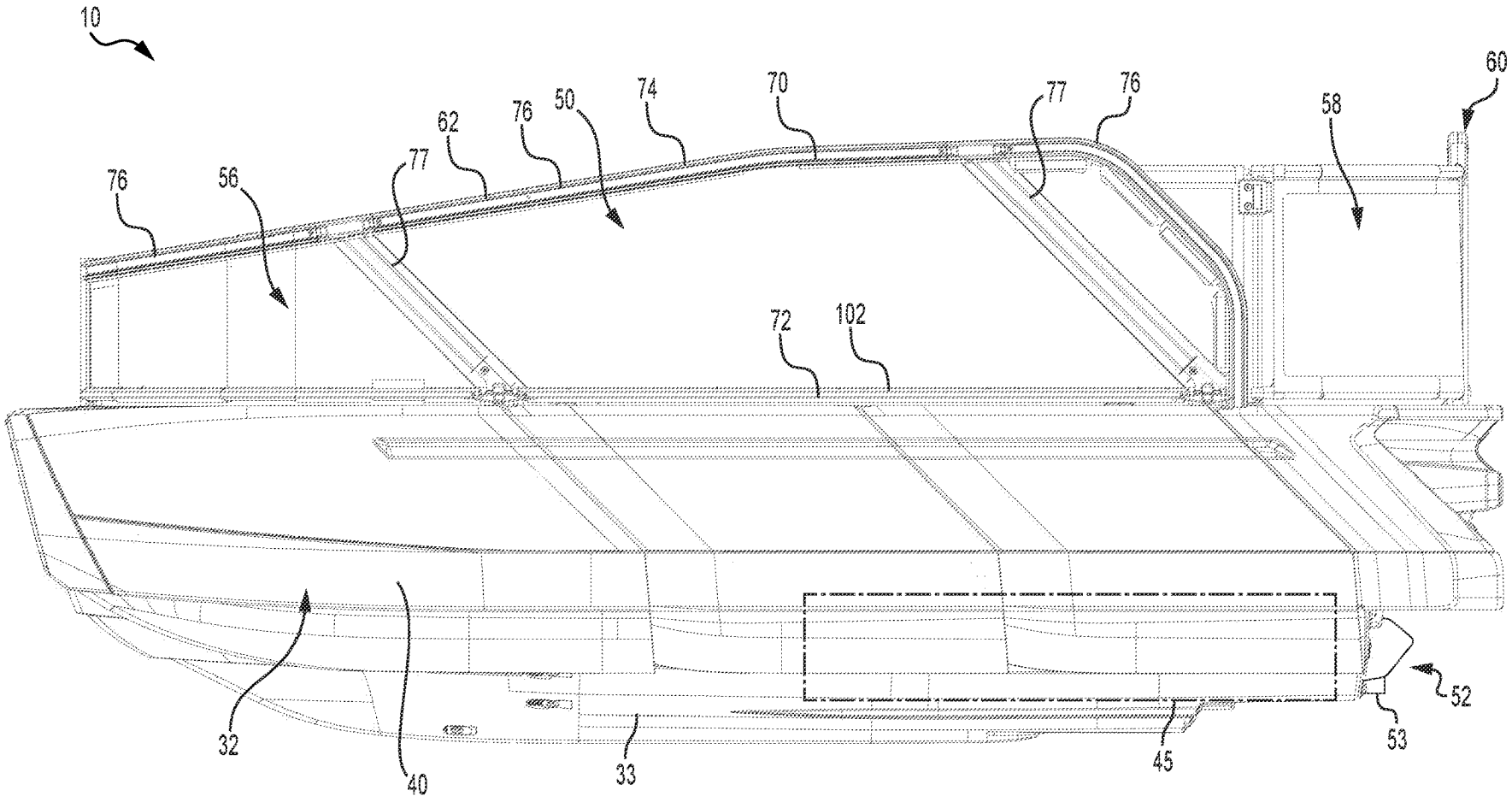
FIG. 3 is a left side elevation view of the pontoon boat of FIG. 1.
Figure 4:
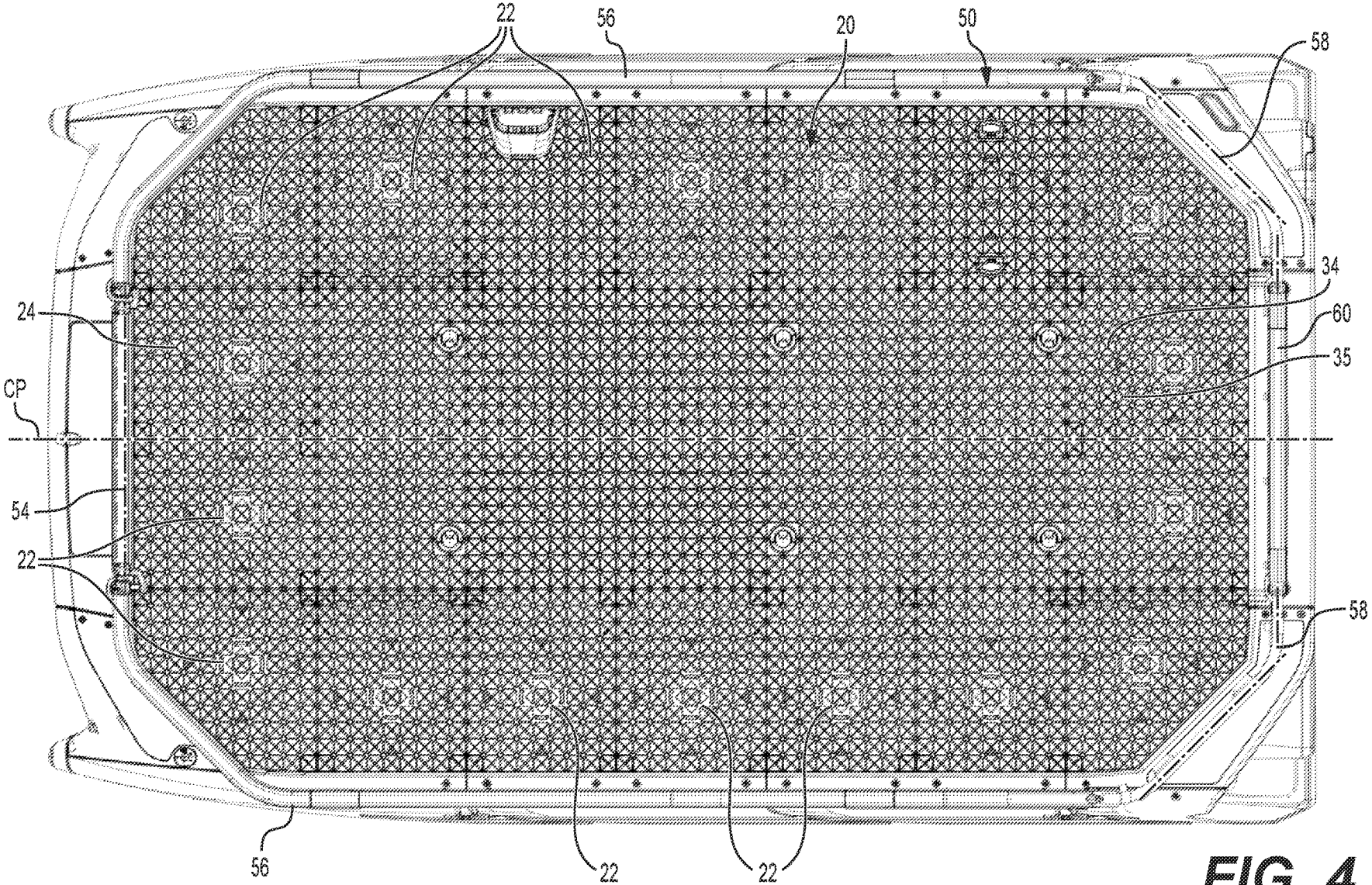
FIG. 4 is a top plan view of the pontoon boat of FIG. 1.

A powerpack 45 (schematically illustrated in FIG. 3) of the boat 10, including the jet propulsion system 52 and the motor, is enclosed in part by the hull 32. As shown in FIG. 4, a central hull cover 34 overlies the powerpack 45 to partly enclose the powerpack 45 between the hull 32 and the hull cover 34. An upper surface 35 of the central hull cover 34 is contiguous with the upper surface 24 of the deck 20 (i.e., flush therewith).

The boat 10 has a barrier structure 50 surrounding at least part of the deck 20 and extending upwardly therefrom. In particular, the barrier structure 50 is located along a periphery of the boat 10 (as defined by the deck 20) to prevent occupants or objects on the deck 20 from accidentally falling off the boat 10. As shown in FIGS. 1 to 4, in this embodiment, the barrier structure 50 generally surrounds the entirety of the deck 20. Notably, the barrier structure 50 includes a front end portion 54, left and right lateral portions 56, left and right rear corner portions 58, and a rear end portion 60. It is contemplated that, in other embodiments, the barrier structure 50 could only partially surround the deck 20. For example, one or more of the portions 54, 56, 58, 60 could be omitted.

As can be seen in FIG. 1, the front end portion 54, the left and right lateral portions 56, the left and right rear corner portions 58, and the rear end portion 60 are shaped differently and in some cases constructed differently. Nevertheless, in this embodiment, each of the portions 54, 56, 58, 60 includes a pliable sheet wall. As will be described below, the inclusion of a pliable sheet wall makes the construction of the barrier structure 50 less expensive than conventional solutions. Moreover, the pliable sheet wall, along with its supporting frame, is easy and therefore less expensive to install.

Figure 5:
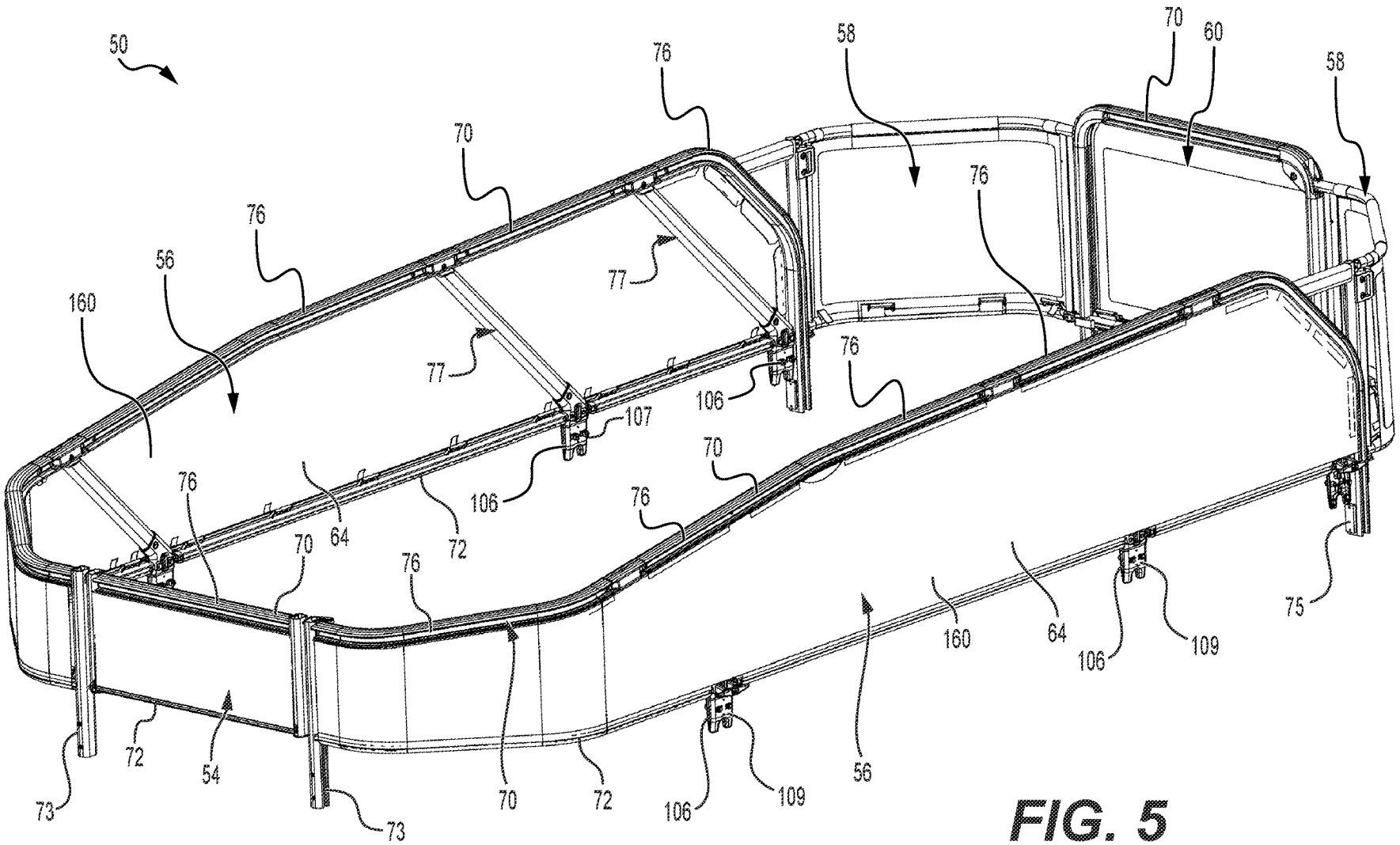
FIG. 5 is a perspective view, taken from a top front left side, of a barrier structure for the pontoon boat of FIG. 1 in accordance with another embodiment.
Figure 6:
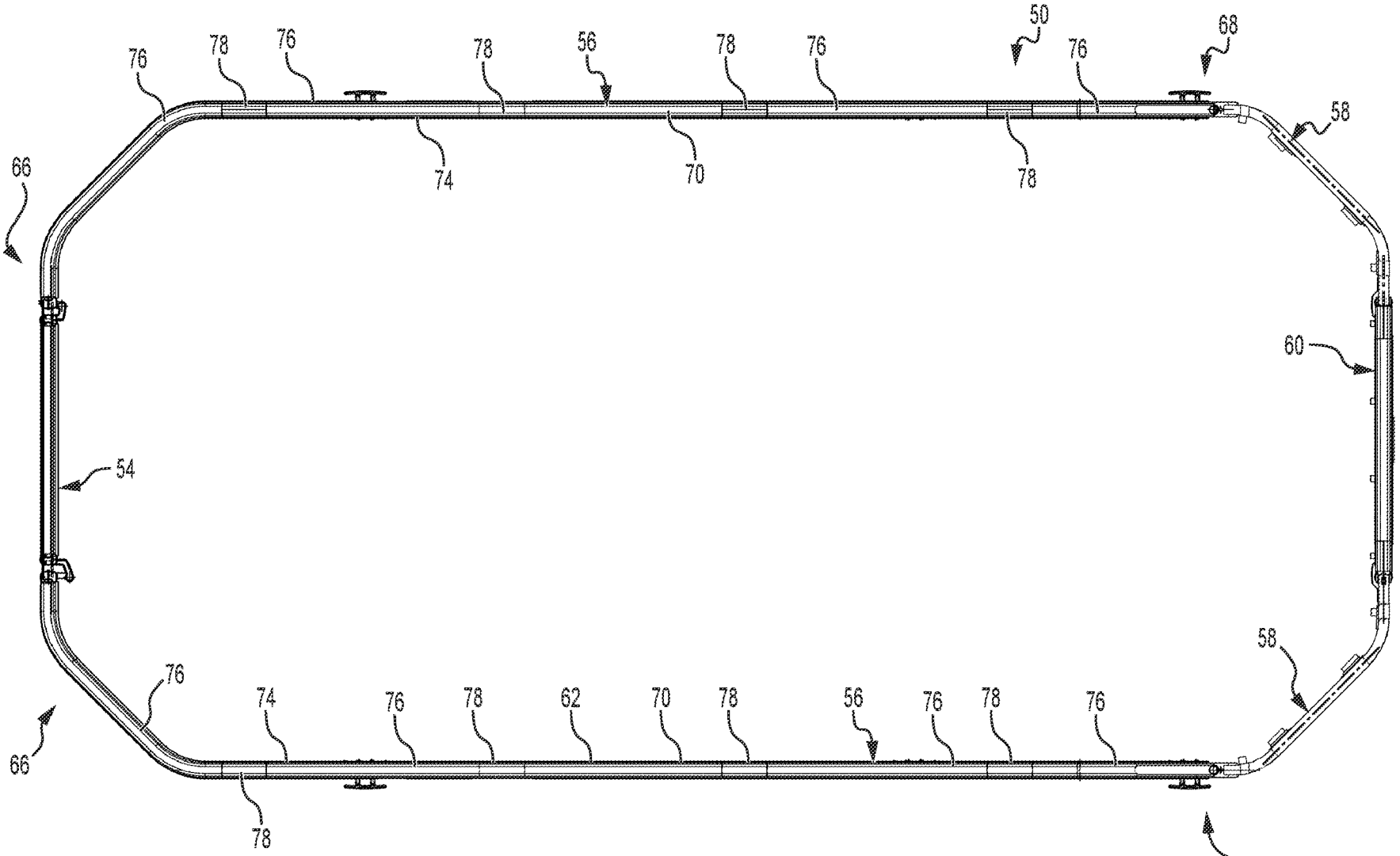
FIG. 6 is a top plan view of the barrier structure of FIG. 5.

Furthermore, the barrier structure 50 is adaptable to the different possible lengths of the boat 10 mentioned above with regard to the modular construction of the deck 20 and the hull 32. In other words, depending on the modular construction of the deck 20 and the hull 32, the barrier structure 50 can be made longer or shorter accordingly. More specifically, as shown in FIGS. 5 and 6, the lateral portions 56 of the barrier structure 50 can be made longer by including additional frame members thereof as will be discussed in more detail below.

The construction of the lateral portions 56 illustrated in FIGS. 5 and 6 will be described in more detail below as their construction is applicable to other portions of the barrier structure 50. As the left and right lateral portions 56 are mirror images of one another about a longitudinal centerplane CP (FIG. 4) of the boat 10, only the left lateral portion 56 will be described in detail herein. It is to be understood that the same description applies to the right lateral portion 56.

Figure 7:
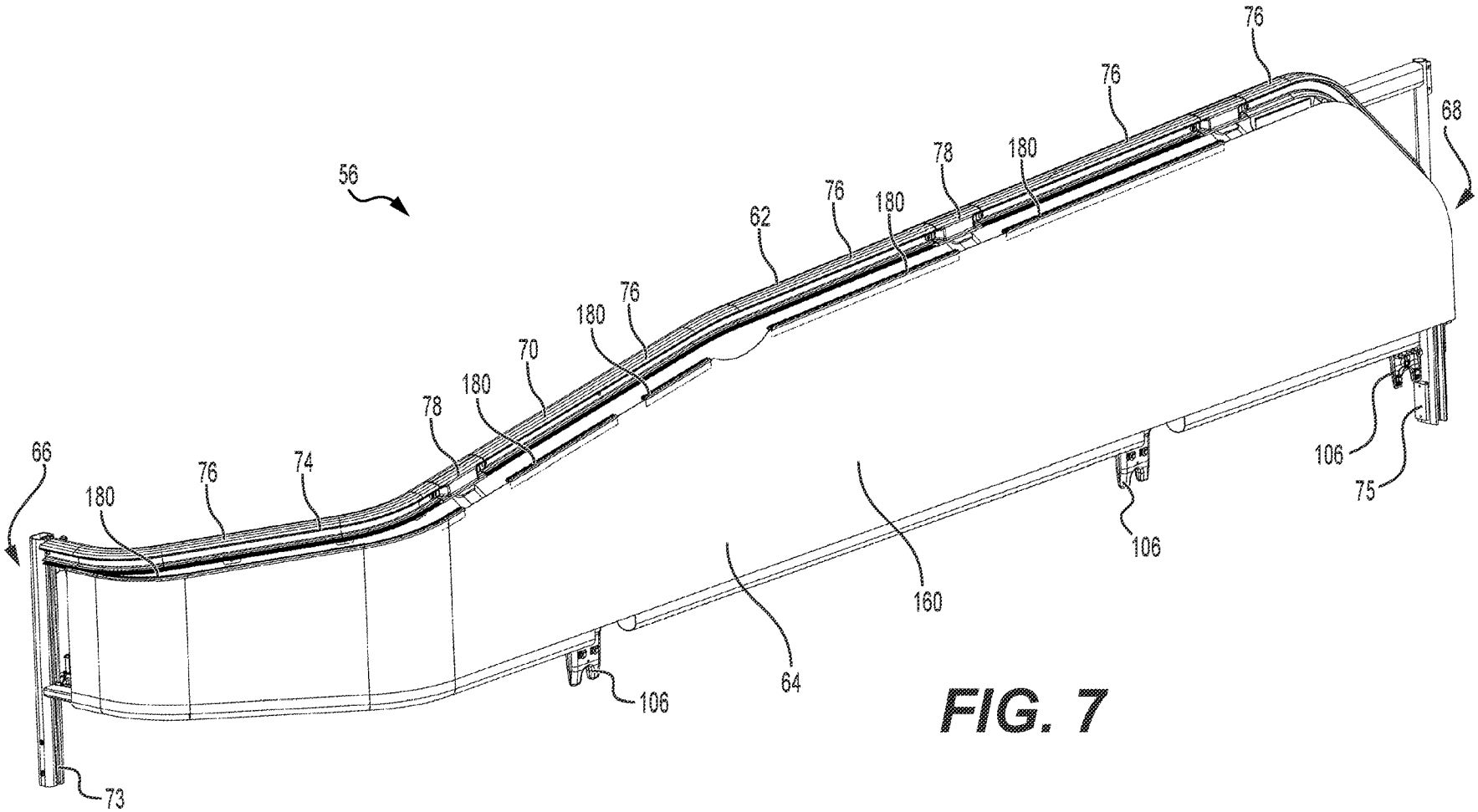
FIG. 7 is a partially exploded view of a left lateral portion of the barrier structure of FIG. 5.

With reference to FIG. 7, the lateral portion 56 of the barrier structure 50 has a frame 62 and a pliable sheet wall 64 connected thereto. As will be described below, the frame 62 connects the lateral portion 56 of the barrier structure 50 to the hull 32 of the boat 10. The pliable sheet wall 64 is stretched over the frame 62 to form an enclosure around the deck 20.

The frame 62 extends generally longitudinally from a front end 66 to a rear end 68. The frame 62 has an upper portion 70 and a lower portion 72 connected to one another. Notably, a front end member 73, a rear end member 75 and a plurality of support members 77 extend between the upper and lower portions 70, 72 of the frame 62. In particular, the support members 77 (best seen in FIGS. 1 and 3), which are disposed longitudinally between the front and rear end members 73, 75, extend generally upwardly and forwardly from the lower portion 72 to the upper portion 70 of the frame 62. The front and rear end members 73, 75 are connected to the hull 32. As can be seen in FIGS. 3 and 5, the spacing between the upper and lower portions 70, 72 can vary. For instance, in this embodiment, the vertical distance between the upper and lower portions 70, 72 is smallest near the front end 66 of the frame 62 and greatest near the rear end 68 of the frame 62.

The upper portion 70 of the frame 62 includes a rail 74 configured for grabbing by a user's hand. The rail 74 is thus also commonly referred to as a "hand rail" or a "hand hold". Notably, in the present application, the rail 74 is defined as a structure that can be grabbed by a user's hand in compliance with different international standards such as American Boat and Yacht Council (ABYC) H-41 regulations on "Reboarding Means, Ladders, Handholds, Rails and Lifelines" and ISO 15085. The rail 74 includes a plurality of rail members 76 that are connected to one another by interconnectors 78 extending between consecutive ones of the rail members 76. Notably, as shown in FIG. 7, each interconnector 78 is fastened to two of the rail members 76. As will be described in more detail below, the interconnectors 78 are also used for connecting the support members 77 between the upper and lower portions 70, 72 of the frame 62.

As will be understood from comparing the barrier structures 50 of FIGS. 1 and 5, the length of the lateral portion 56 of the barrier structure 50 can be changed simply by adding or removing rail member 76 to make the rail 74 longer or shorter. This allows adapting the barrier structure 50 in accordance with the size of the boat 10 that it is intended to be installed on.

Figure 10A:
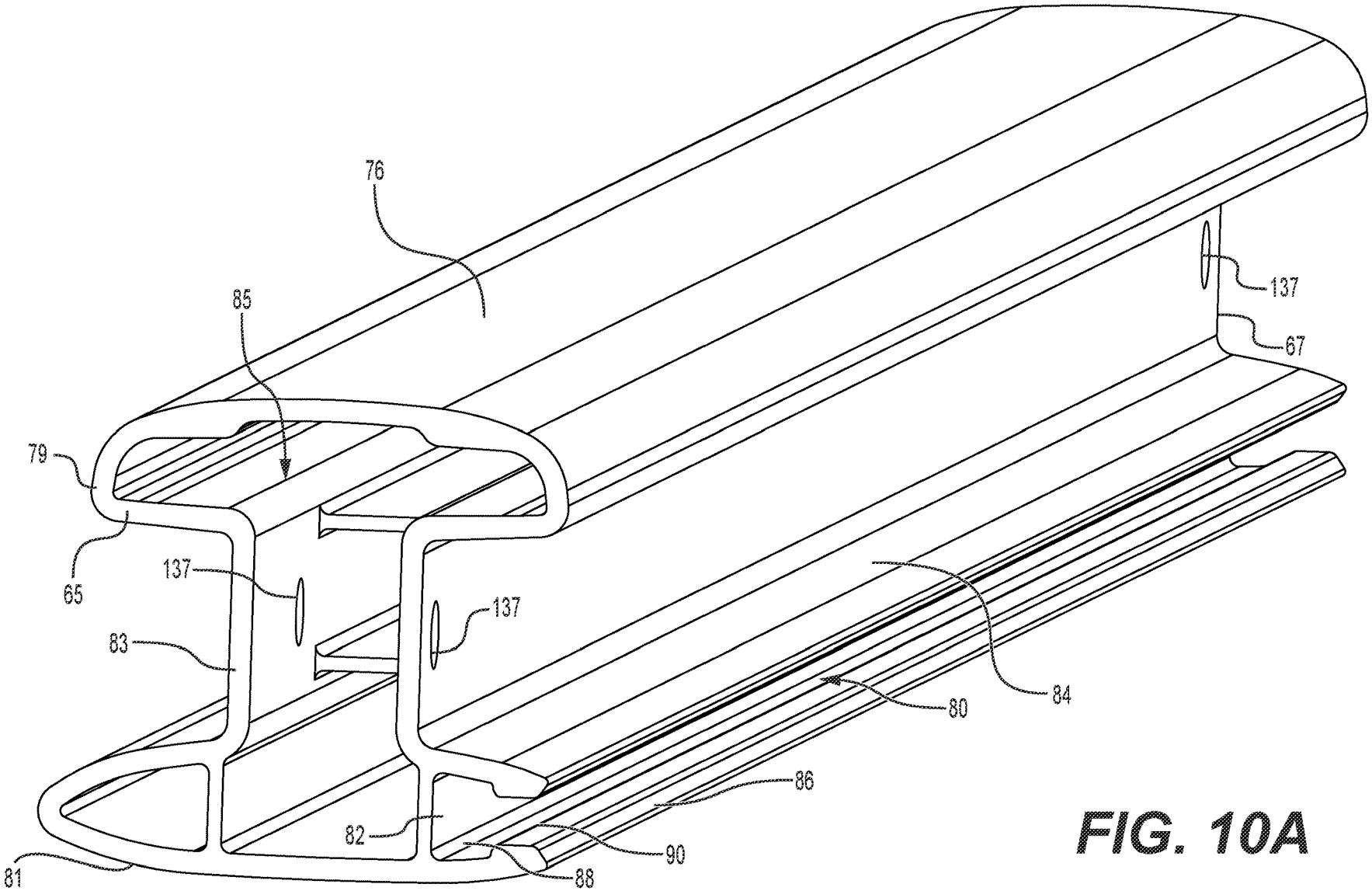
FIG. 10A is a perspective view, taken from a top front left side, of a rail member of the left lateral portion of FIG. 7.
Figure 10B:
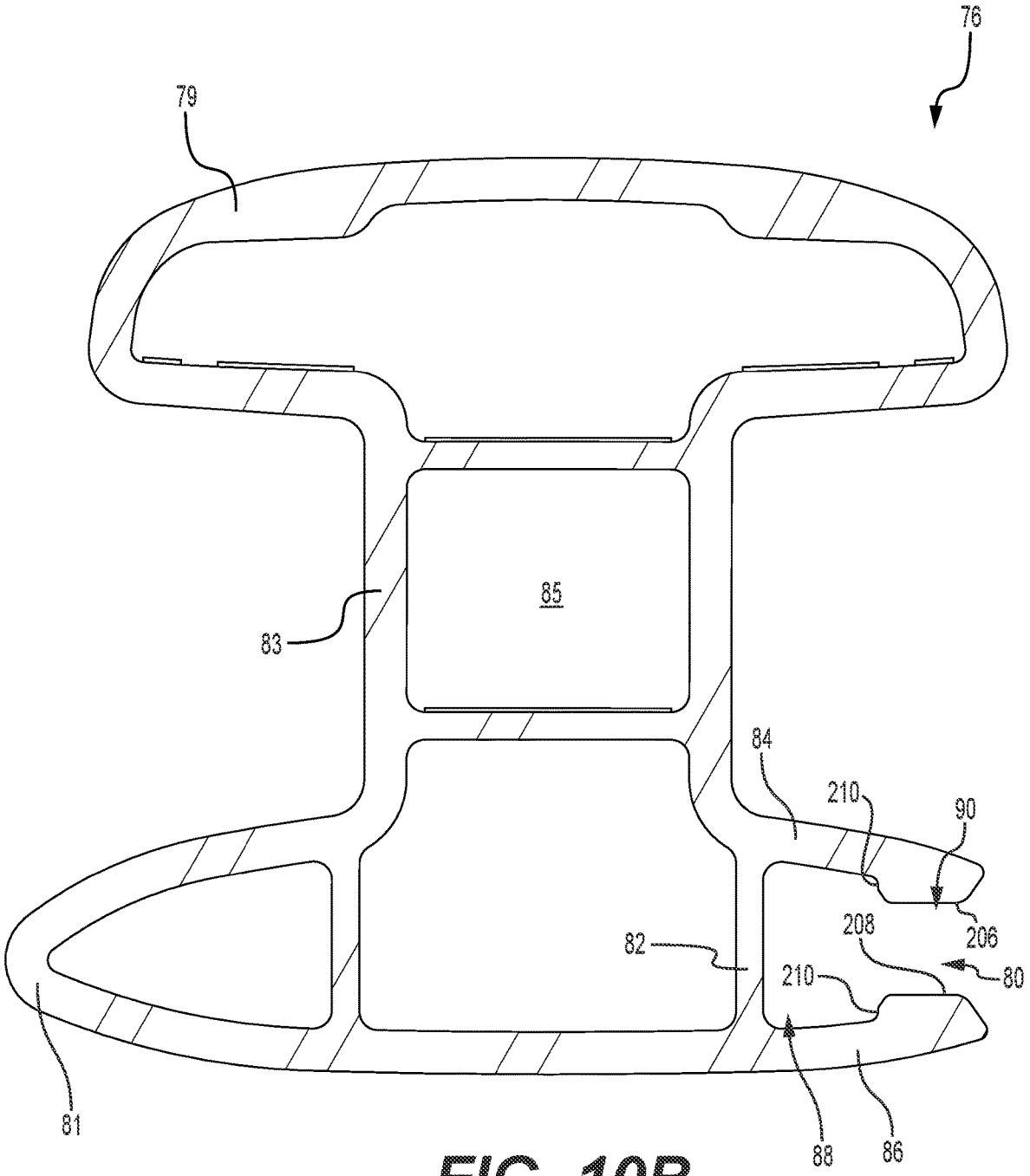
FIG. 10B is a cross-sectional view of the rail member of FIG. 10A.

In this embodiment, each rail member 76 has the same cross-sectional profile shown in FIGS. 10A and 10B. Therefore, only one of the rail members 76 will be described in detail herein. It is understood that the same description applies to the other rail members 76 unless mentioned otherwise. As can be seen, the cross-sectional profile of the rail member 76 is generally I-shaped, notably including a wide upper portion 79, a wide lower portion 81 and a narrow intermediate portion 83 extending between the wide upper and lower portions 79, 81. In this embodiment, the rail member 76 is an extruded component and defines an interior hollow space 85 therein.

In order to connect the pliable sheet wall 64 to the rail 74, the rail member 76 defines a channel 80 extending along a length of the rail member 76, namely between its opposite ends 65, 67. Notably, as will be described in greater detail below, the channel 80 is configured to receive an interlocking member of the pliable sheet wall 64.

With reference to FIG. 10B, the channel 80 is defined by the wide lower portion 83 of the rail member 76 on a laterally-outward side thereof such that the channel 80 extends along a laterally-outward side of the rail member 76 and thus of the rail 74. In particular, the channel 80 is defined between three channel walls 82, 84, 86 of the lower portion 81 of the rail member 76. The channel walls 84, 86 extend generally horizontally and are disposed opposite one another. The channel wall 82 extends between the two opposite walls 84, 86. As such, the channel wall 82 may be referred to as the "bottom" wall of the channel 80. The two opposite walls 84, 86 are shaped such as to form an enlarged section 88 and a constricted section 90 of the channel 80. These sections are referred to as such because the spacing between the two opposite walls 84, 86 is greater at the enlarged section 88 than at the constricted section 90. As can be seen, the enlarged section 88 is positioned closer to the bottom wall 82 than the constricted section 90. In particular, in this embodiment, the enlarged section 88 is adjacent to the bottom wall 82 and is thus defined in part thereby, while the constricted section 90 is further from the bottom wall 82. Notably, the enlarged section 88 separates the constricted section 90 from the bottom wall 82.

It should be noted that while the rail member 76 illustrated in FIG. 10A is generally straight, this is not the case for all the rail members 76 of the rail 74. Notably, some of the rail members 76 are curved but nevertheless have the same cross-sectional profile as that described in relation to FIGS. 10A and 10B.

Figure 9:
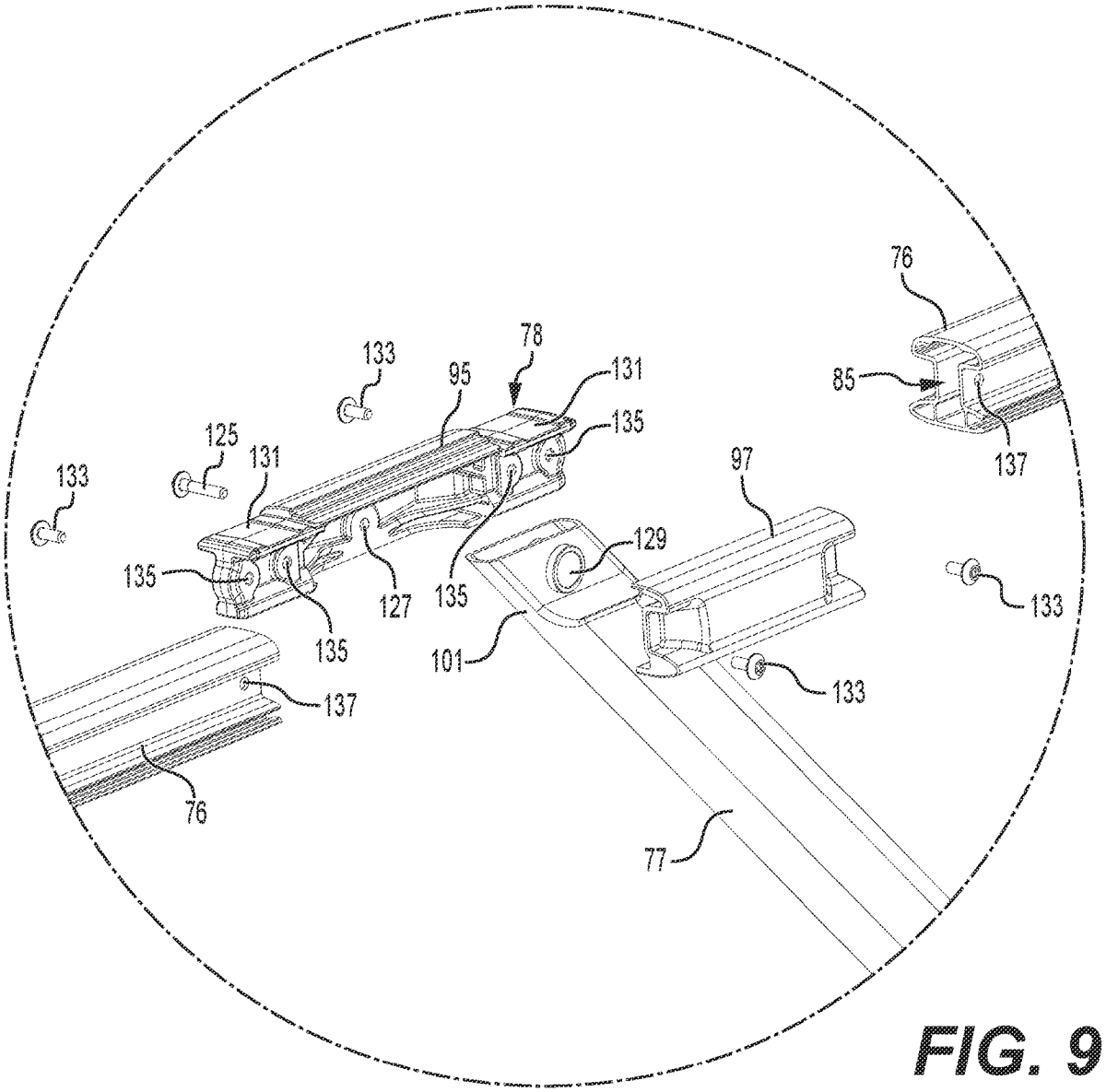
FIG. 9 is a close-up view of part of FIG. 8.

With reference to FIG. 9, each interconnector 78 includes an inner member 95 and an outer member 97. The inner and outer members 95, 97 are fastened to one another to define a cavity therebetween. The cavity is accessible by an opening formed between the lower ends of the two inner and outer members 95, 97. An upper end portion 101 of a corresponding support member 77 is enclosed in the cavity between the inner and outer members 95, 97, with the remainder of the support member 77 extending downward from the interconnector 78 through the opening formed between inner and outer members 95, 97. A fastener 125 extends through a central opening 127 defined by the inner member 95 and through a corresponding opening 129 defined by the upper end portion 101 of the support member 77 and threadedly engages a threaded opening (not shown) defined by the outer member 97. The end portions 131 of the inner member 95 inserted into the hollow spaces 85 of corresponding adjacent ones of the rail members 76. Fasteners 133 are inserted through respective openings 137 defined by the ends of the rail members 76 (see FIG. 10A) and threadedly engage threaded openings 135 defined by the inner member 95.

Figure 8:
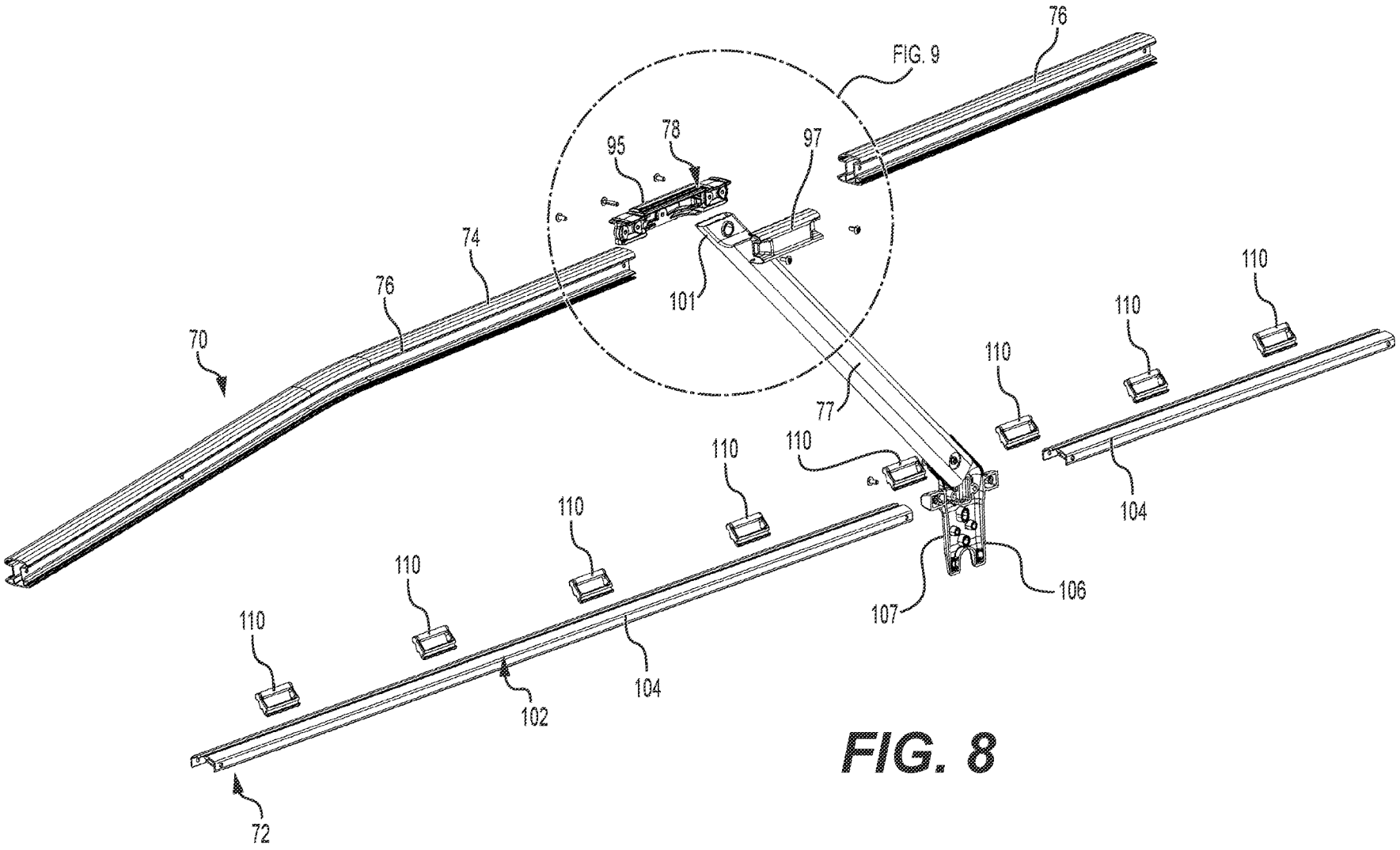
FIG. 8 is an exploded view of part of a frame the left lateral portion of the barrier structure of FIG. 7.

Turning now to the lower portion 72 of the frame 62, with reference to FIG. 8, the lower portion 72 of the frame 62 includes a lower railing 102 that extends below the rail 74 of the upper portion 70. The lower railing 102 extends generally parallel to the upper surface 24 of the deck 20. The lower railing 102 has a plurality of lower railing members 104 that are interconnected to one another by lower frame connectors 106. As will be described in more detail below, the lower frame connectors 106 also connect the lower railing 102 to the hull 32. Notably, the lower frame connectors 106 extend downwardly from the lower railing 102 into a recess 316 (FIG. 21) defined between the hull 32 and the deck 20 to connect to a member of the hull 32 therein.

Figure 12:
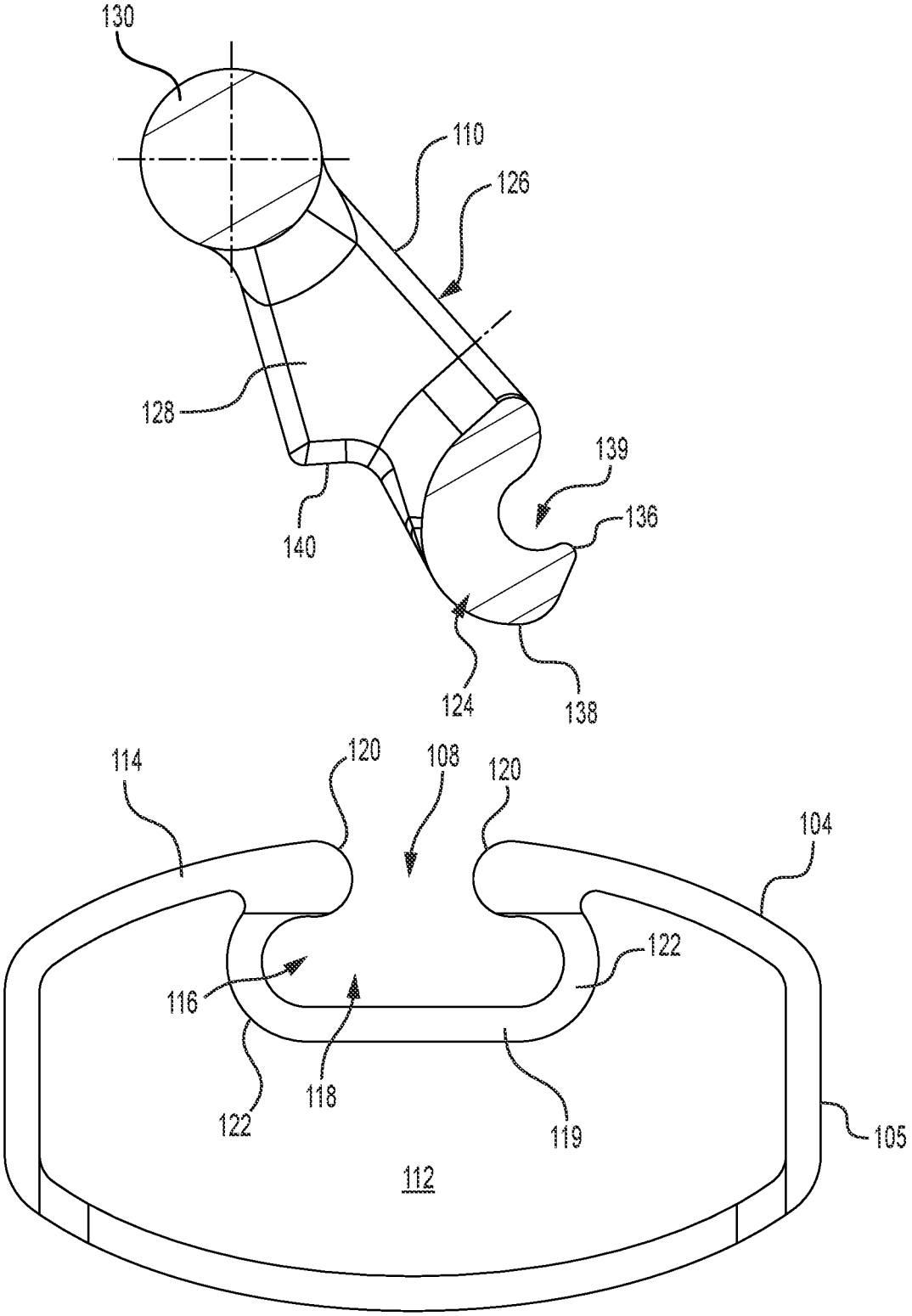
FIG. 12 is a cross-sectional view of an exploded configuration of the lower railing of FIG. 11 and a lower anchor.
Figure 13:
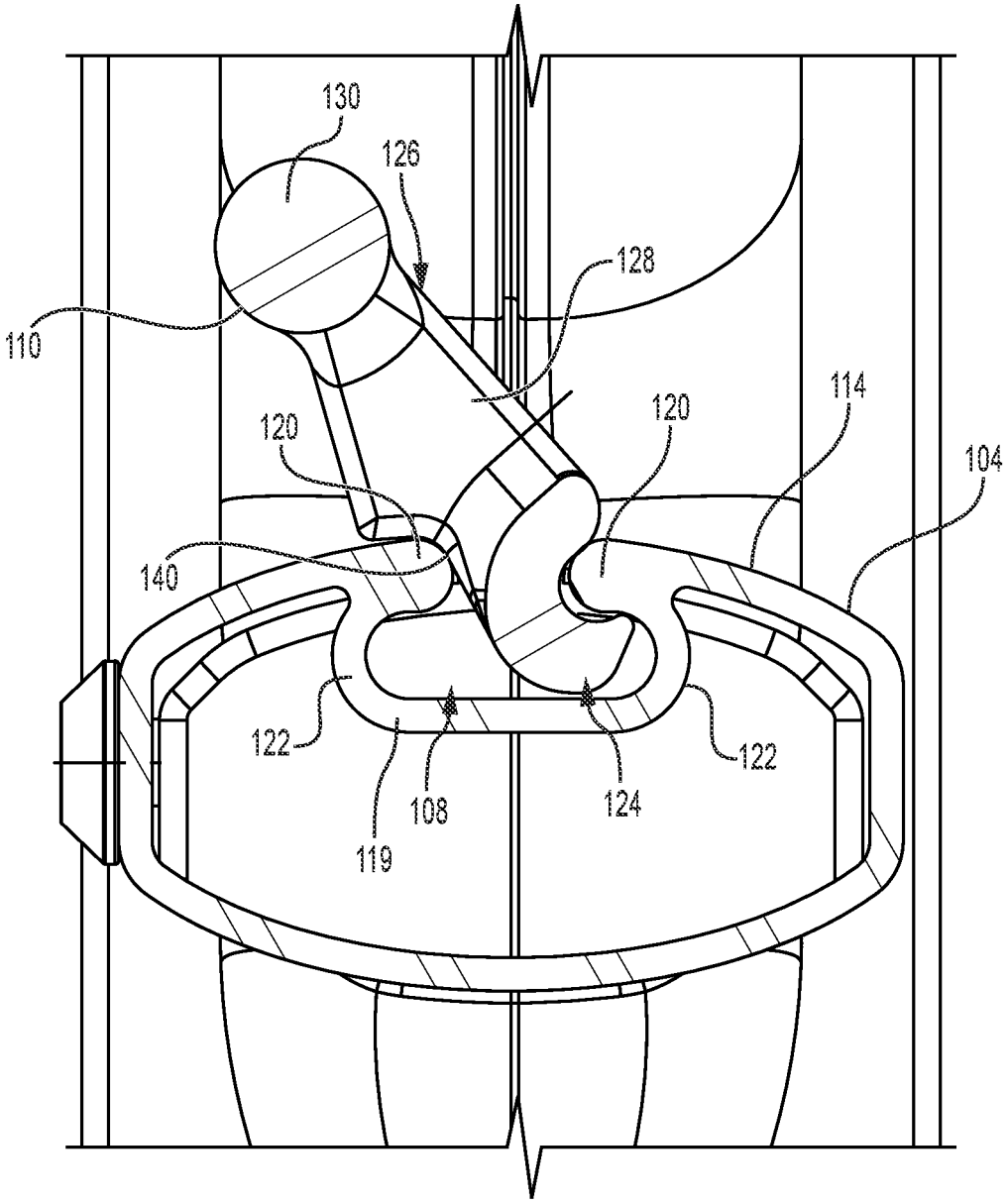
FIG. 13 is a cross-sectional view of the lower railing and the lower anchor of FIG. 12 in an assembled configuration.

In this embodiment, each lower railing member 104 has the same cross-sectional profile shown in FIGS. 12 and 13. Therefore, only one of the lower railing members 104 will be described in detail herein. It is understood that the same description applies to the other lower railing members 104 unless mentioned otherwise. As can be seen, in this embodiment, the cross-sectional profile of the lower railing member 104 is generally oval with two truncated ends. Moreover, in this embodiment, the lower railing member 104 is an extruded component having an outer wall 105 defining an interior hollow space 112 therein. An upper portion 114 of the outer wall 105, facing upwardly toward the upper portion 70 of the frame 62, defines an anchor mounting channel 108 configured to receive therein one or more lower anchors 110 as will be described in greater detail below. As shown in FIG. 12, the anchor mounting channel 108 has a narrow section 116 and an enlarged section 118 that is wider than the narrow section 116. The narrow section 116 of the anchor mounting channel 108 is defined by two rounded upper ends 120 disposed opposite one another. An interior wall 119 defines the enlarged section 118 of the anchor mounting channel 108. The interior wall 119 extends downwardly from the upper ends 120 to form two curved lateral ends 122 of the enlarged section 118 of the anchor mounting channel 108, and extends horizontally between the two lateral ends 122.

Figure 11:
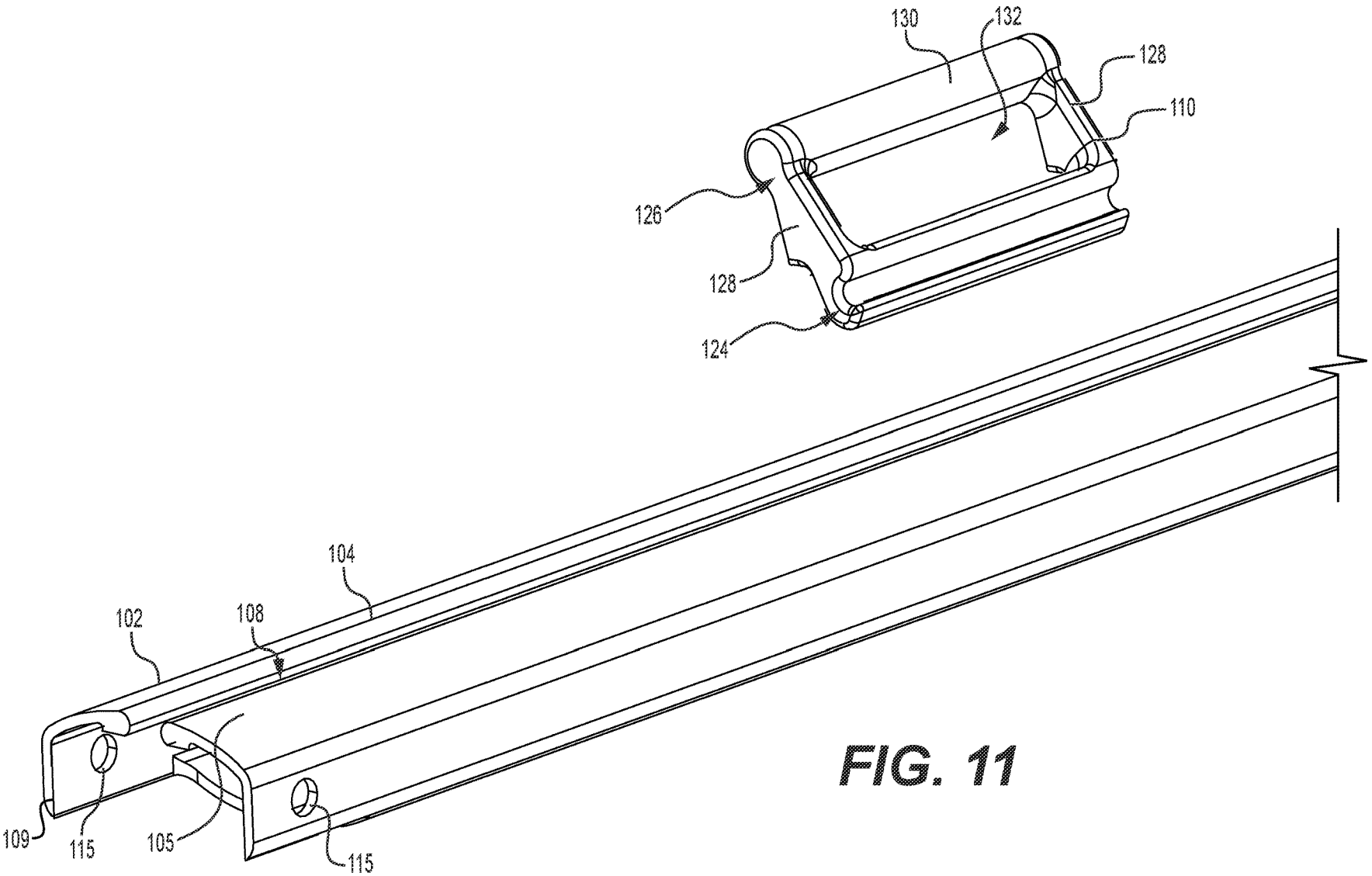
FIG. 11 is a close-up view of part of FIG. 8, showing part of a lower railing of the left lateral portion of the barrier structure of FIG. 7.

As can be seen in FIG. 11, the end portions 109 of the lower railing member 104 do not have the same cross-sectional profile as that shown in FIGS. 12 and 13. Notably, the end portions 109 have two spaced opposite walls corresponding to the ends of the oval shaped cross-sectional profile shown in FIGS. 12 and 13. Each of the two walls of the end portions 109 of the lower railing member 104 defines a respective opening 115 to fasten the lower railing member 104 to the lower frame connectors 106, as will be explained in more detail below.

The lower anchors 110 are provided to connect the lower edge of the pliable sheet wall 64 to the lower rail 102. In particular, as will be described in greater detail below, the lower anchors 110 are configured to be interlocked with the lower railing 102 via the lower anchor channels 108 of the lower railing members 104.

In this embodiment, each lower anchor 110 is identical and therefore only one of the lower anchors 110 will be described in detail herein. It is understood that the same description applies to the other lower anchors 110. With reference to FIG. 11, the lower anchor 110 has an interlocking portion 124 and a loop portion 126 extending upwardly therefrom. The loop portion 126 includes two arms 128 spaced apart from one another and a bar 130 extending between the upper ends of the two arms 128. The lower ends of the two arms 128 are connected to one another by the interlocking portion 124 extending therebetween. As such, an opening 132 is defined between the arms 128, the bar 130 and the interlocking portion 124. As will be described in more detail below, the opening 132 is configured to receive a strap to connect the lower end of the pliable sheet wall 64 to the lower anchor 110.

With reference now to FIG. 12, the interlocking portion 124 of the lower anchor 110 is generally hook-shaped. Notably, the hook shape of the interlocking portion 124 defines a cavity 139. The interlocking portion 124 has a tip 136 and a cam surface 138 extending from the tip 136. The cam surface 138 defines the exterior portion of the hook-shaped interlocking portion 124. As will be seen below, the cam surface 138 is configured for securing the interlocking portion 124 to the corresponding lower anchor 110. On a side of the interlocking portion 124 opposite the tip 136 and the cavity 139, the interlocking portion 124 has a curved surface 140.

Figure 17:
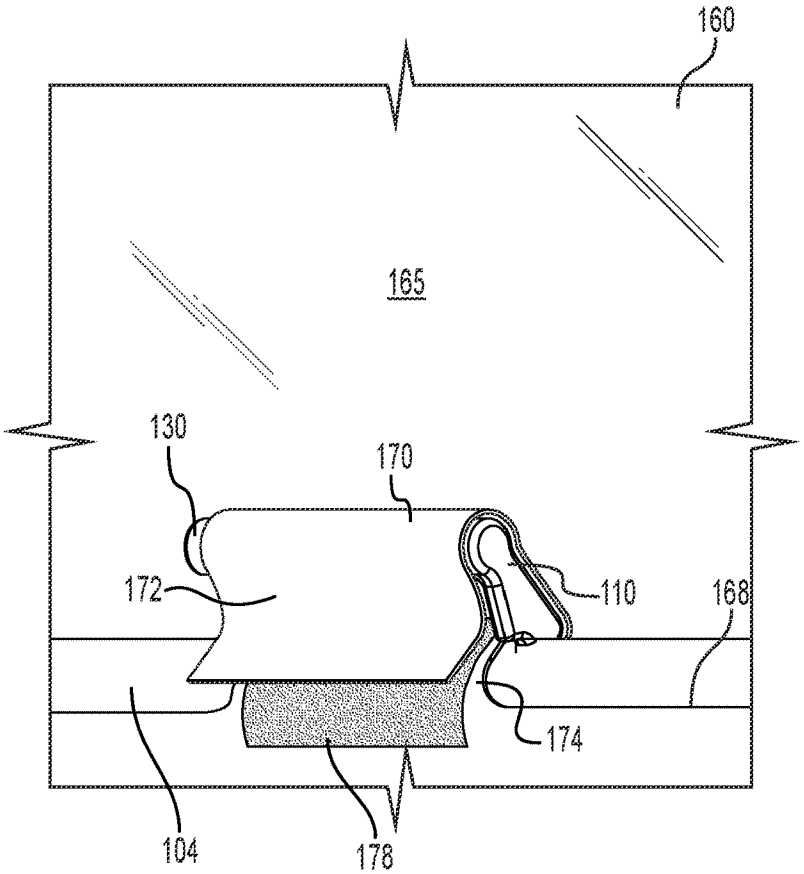
FIG. 17 is a perspective view of the lower anchor and the attachment portion of FIG. 16, showing the attachment portion in a secured state.

Turning now to FIG. 13, in order to secure the lower anchor 110 to a corresponding lower railing member 104, the tip 136 of the interlocking portion 124 of the lower anchor 110 is first inserted into the lower anchor channel 108 of the lower railing member 104. The lower anchor 110 is then rotated so that the tip 136 of the interlocking portion 124 rotates upwardly. As the lower anchor 110 rotates, one of the rounded upper ends 120 is received in the cavity 139 of the interlocking portion 124, and the cam surface 138 of the interlocking portion 124 contacts the interior wall 119 of the lower railing member 104. The lower anchor 110 is rotated within the channel 108 of the lower railing member 104 until the cam surface 138 engages the interior wall 119 in the position shown in FIG. 13. As can be seen, in this position, the tip 136 contacts the underside of the corresponding rounded upper end 120 while the curved surface 140 is in contact with the opposite rounded upper end 120. Notably, the curved surface 140 has a radius of curvature appropriate for snugly receiving the rounded upper end 120. In this position, an attachment portion 170 (FIGS. 15-17) provided along the lower edge of the pliable sheet wall 64 will be wrapped around the bar 130, as will be discussed in further detail below. The attachment of the attachment portion 170 to the bar 130 prevents the lower anchor 110 from rotating so as to disengage the interlocking portion 124 from the interior wall 119 and the rounded upper ends 120. In addition, the lower anchor 110 and the lower railing member 104 are sized and shaped so as to provide a degree of interference between the interlocking portion 124 and the lower railing member 104 such that a force must be applied in the opposite direction of rotation to disengage the lower anchor 110 from the lower railing member 104, notably to overcome the resistance posed by the engagement of the cam surface 138 against the interior wall 119. It is contemplated that no interference be provided.

Figure 14A:
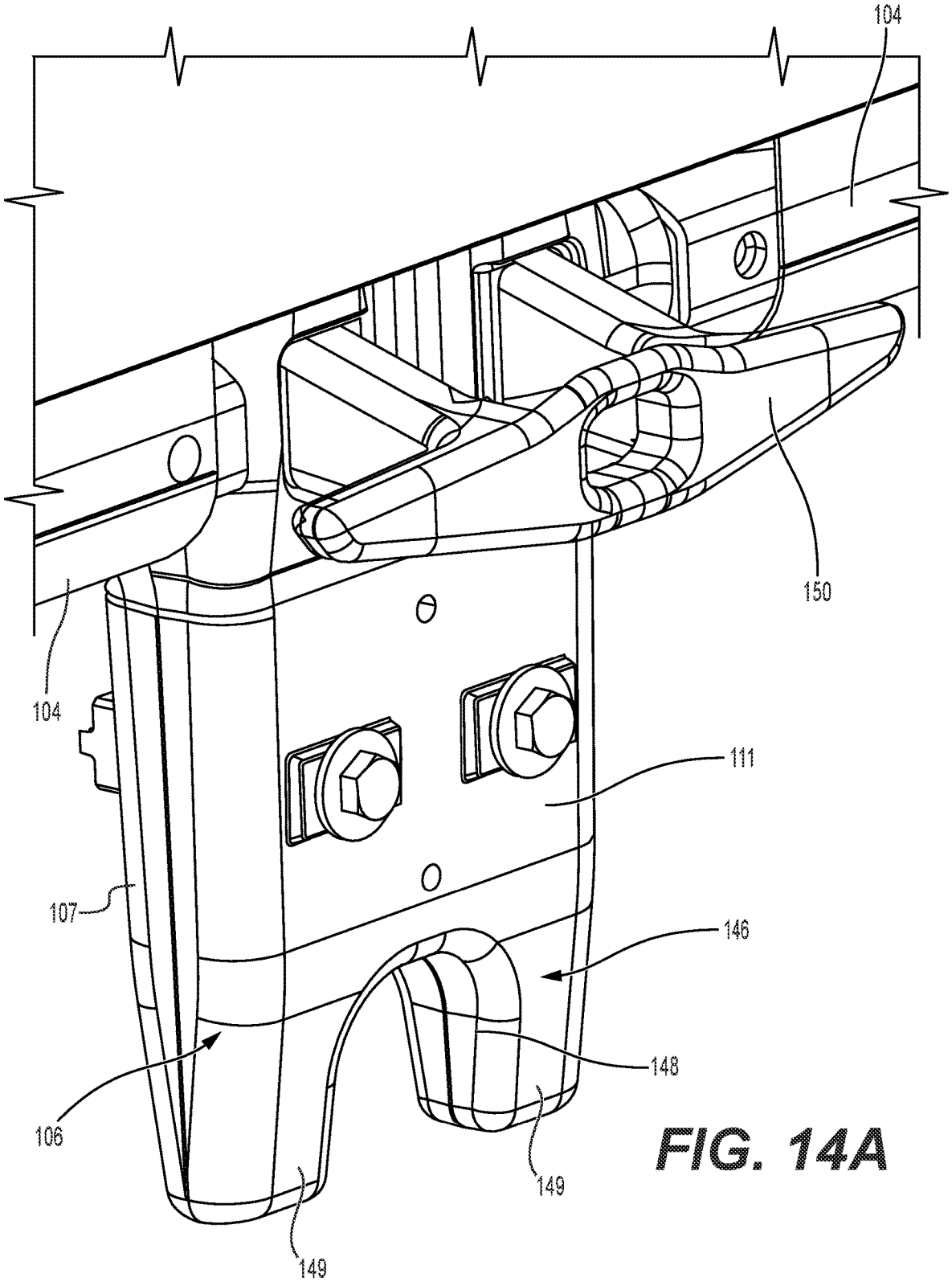
FIG. 14A is a close-up view of part of the barrier structure of FIG. 5, showing a lower frame connector of the left lateral portion thereof.
Figure 14B:
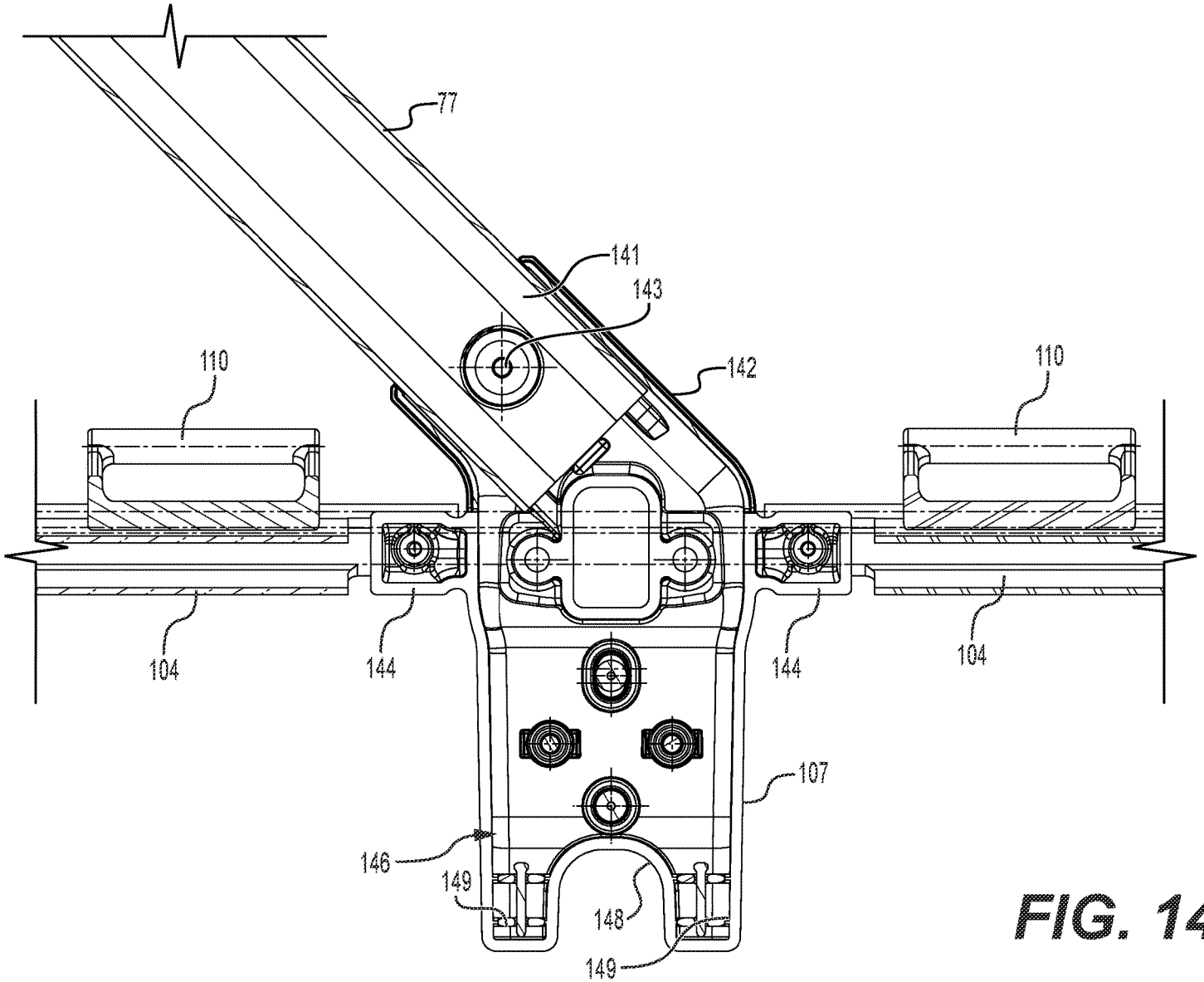
FIG. 14B is a cross-sectional view of the lower frame connector of FIG. 14A.

With reference now to FIGS. 14A and 14B, two consecutive ones of the lower railing members 104 are connected to one another via one of the lower frame connectors 106. Each lower frame connector 106 has an inner member 107 and an outer member 111 that are connected to one another. The lower frame connector 106 receives therein a lower end portion 141 of a corresponding one of the support members 77. Notably, as shown in FIG. 14B, the lower frame connector 106 has an upper diagonal portion 142 extending generally upwardly and forwardly and defining a cavity therein to receive the lower end portion 141 of the corresponding support member 77. A fastener extends through an opening 143 defined by the lower end portion 141 of the support member 77 and is threadedly received by a threaded opening in the outer member 111 (not shown). As shown in FIG. 14B, the lower frame connector 106 has two end portions 144 that are received in the end portions 109 of the lower railing members 104. Respective fasteners are inserted through the openings 115 (FIG. 11) of the lower railing members 104 and threadedly received in respective openings of the end portions 144 of the lower frame connector 106.

As shown in FIG. 14A, the lower frame connector 106 also has a cleat 150 extending laterally outwardly therefrom for tying the boat 10 to a dock.

Figure 21:
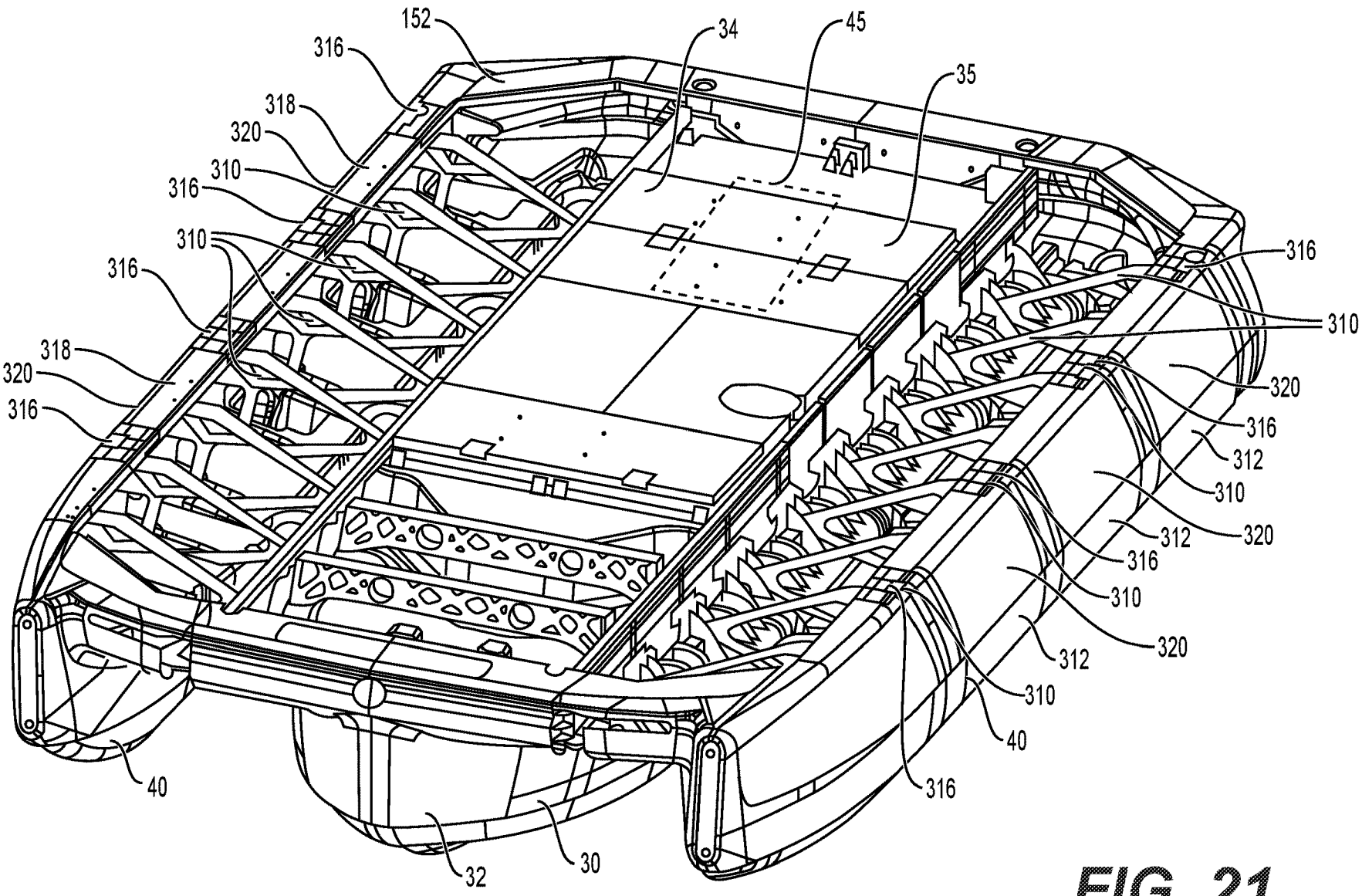
FIG. 21 is a perspective view, taken from a front, left side, of the boat of FIG. 1, with a deck and barrier structure thereof removed to partially expose the interior of a hull of the boat.
Figure 22:
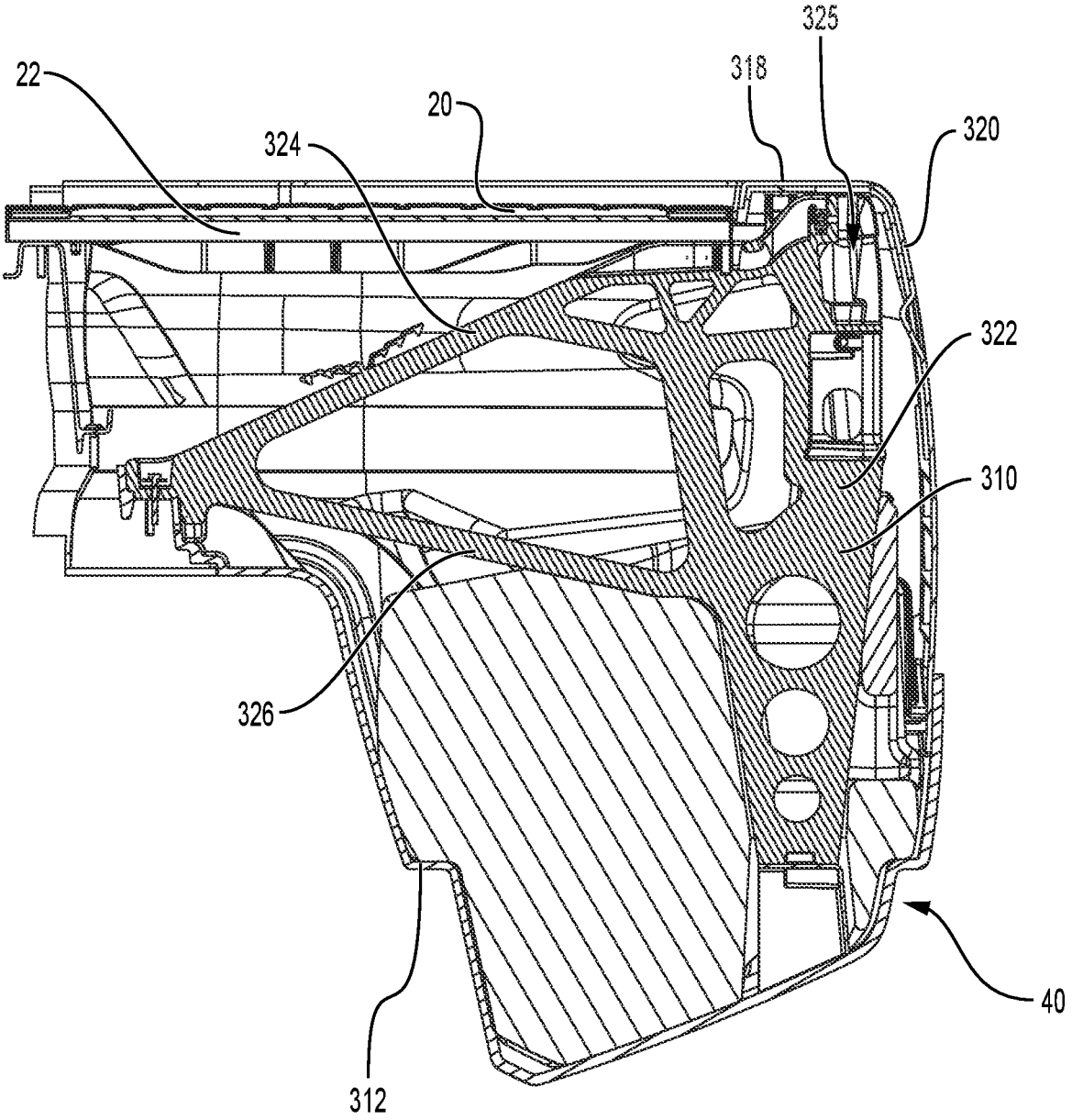
FIG. 22 is a cross-sectional view of a left lateral portion of the hull and corresponding part of the deck of the boat of FIG. 1.
Figure 23:
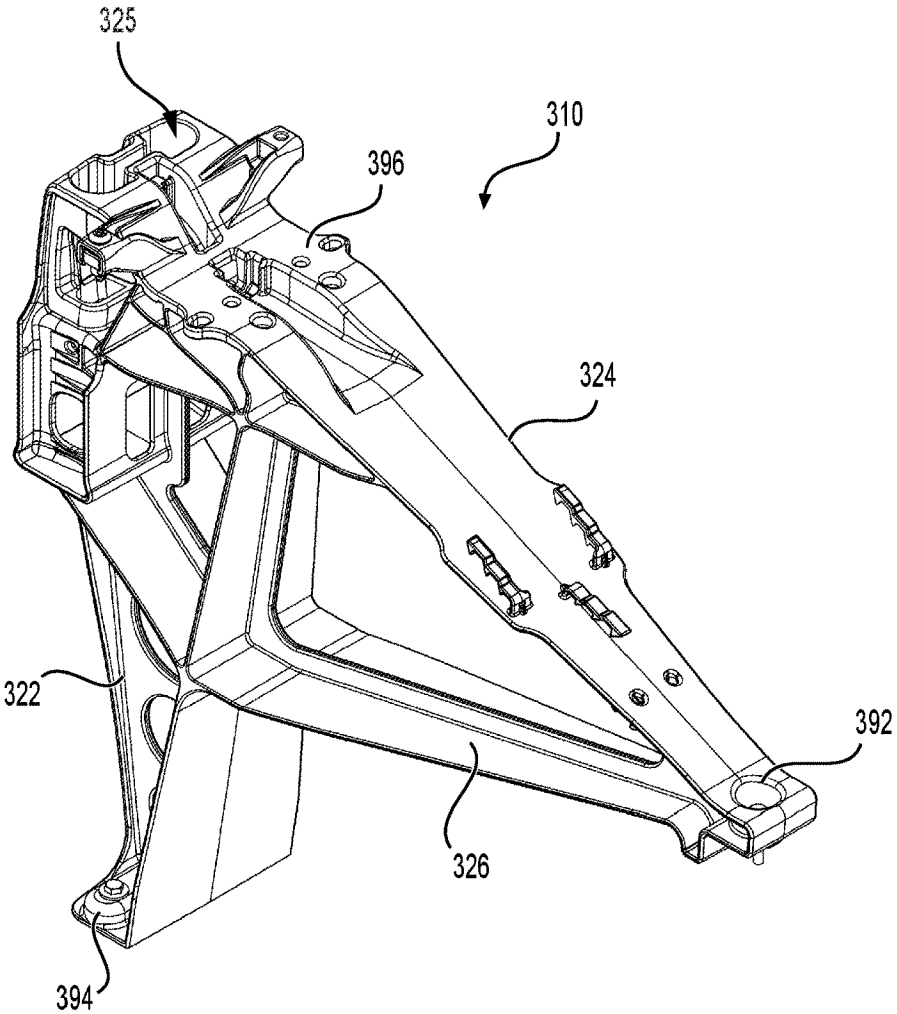
FIG. 23 is a perspective view, taken from a rear, right side, of a brace of a plurality of braces of the left lateral portion of the hull of the boat of FIG. 1.

A lower connecting portion 146 of the lower frame connector 106 is configured to be connected to the hull 32 of the boat 10. As shown in FIGS. 14A and 14B, in this embodiment, the lower connecting portion 146 has two legs 149 defining a U-shaped recess 148 therebetween. The lower connecting portion 146 of the lower frame connector 106 is connected to a corresponding lateral brace 310 of a plurality of braces 310 of the lateral portions 40 of the hull 32 (FIG. 21). The braces 310 are configured for reinforcing the lateral portions 40 of the hull 32 so as to support loads exerted thereon. As can be seen in FIGS. 21 and 22, the braces 310 are longitudinally spaced apart from one another and are connected between the central portion 33 of the hull 32, lower hull panels 312 of the lateral portions 40 of the hull 32 and the deck 20. Notably, with reference to FIGS. 22 to 24, each brace 310 has three beam portions 322, 324, 326 that extend substantially linearly. Notably, the upstanding beam portion 322 extends between an upper mount 396 (to which the deck 20 is connected) and a lower mount 394 (to which a corresponding lower hull panel 312 is connected) and thus extends generally vertically. The upper beam portion 324 extends between an inner mount 392 (to which the central portion 33 of the hull 32 is connected) and the upper mount 396. The lower beam portion 326 extends between the inner mount 392 and the upstanding beam portion 322. For instance, in this embodiment, the lower beam portion 326 extends between the inner mount 392 and a point approximately midway between the ends of the upstanding beam portion 322. However, it is contemplated that the lower beam portion 326 may extend between the inner mount 392 and the lower mount 394 in other embodiments, or between the inner mount 392 and any other point of the upstanding beam portion 322. This configuration of the beam portions 322, 324, 326 provides support for the lateral portion 40 of the hull 32 while simultaneously remaining compact so as to adapt to the limited space available within the lateral portion 40. A complete description of the configuration of the lateral portions 40 of the hull 32, including the braces 310, can be found in U.S. patent application Ser. No. 17/038,662.

Figure 24:
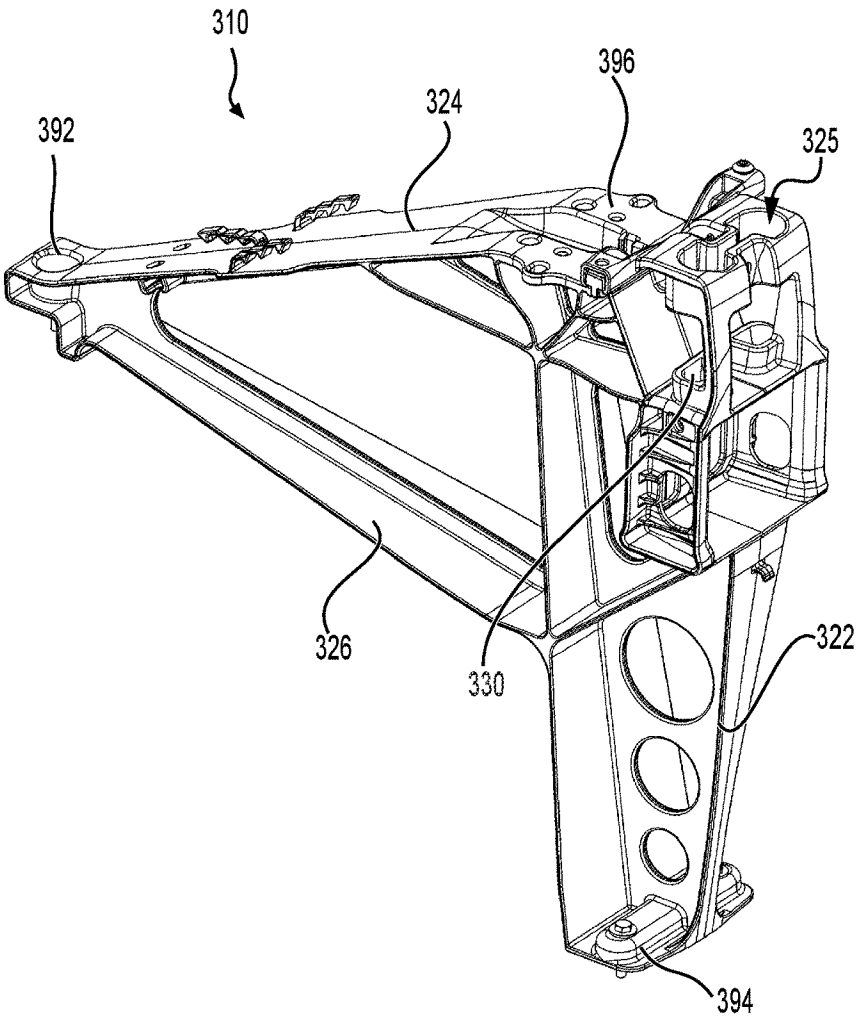
FIG. 24 is a perspective view, taken from a front, left side, of the brace of FIG. 24.

The lower connecting portion 146 of each lower frame connector 106 is inserted in a corresponding recess 316 (FIG. 21) formed between respective edge cover members 318 and lateral side panels 320 of the lateral portions 40 of the hull 32 so that the lower connecting portion 146 extends vertically lower than the deck 20. Furthermore, with reference to FIGS. 22 to 24, the lower connecting portion 146 of each lower frame connector 106 is received in a recess 325 defined at an upper end of the upstanding beam portion 322 of the corresponding brace 310. The recess 325 is shaped to have the contour of the cross-sectional profile of the lower connecting portion 146 so as to provide a close fit thereto. Each of the legs 149 of the lower connecting portion 146 is received and sits in a corresponding pocket 330 (FIG. 24)

formed by the upstanding beam portion 322. One or more fasteners (not shown) are then inserted through the brace 310 and into the lower connecting portion 146 to secure the lower frame connector 106 to the hull 32.

While the lower connecting portion 146 is connected to the hull 32 in this embodiment, it is contemplated that, in other embodiments, the lower connecting portion 146 could be additionally or alternatively connected to the deck 20.

Figure 15:
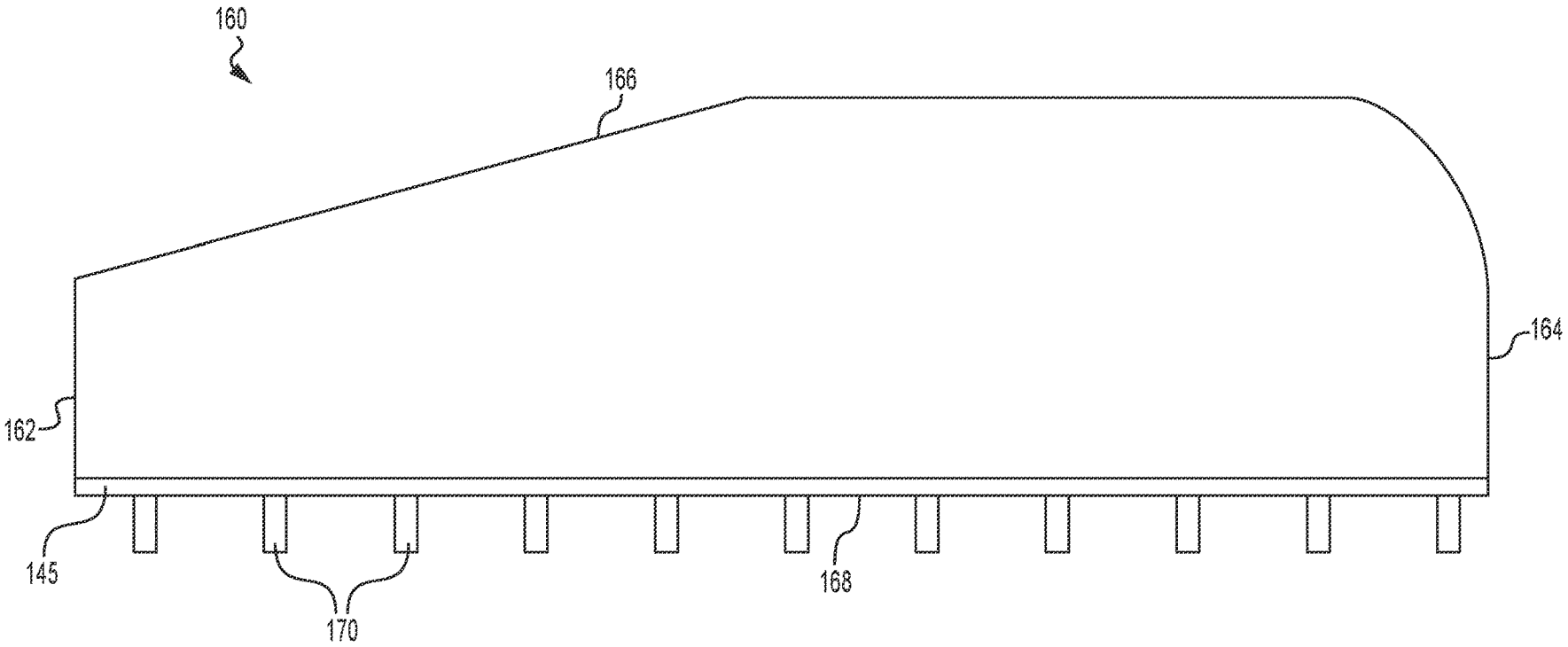
FIG. 15 is a left side elevation view of a pliable sheet panel of a pliable sheet wall of the left lateral portion of FIG. 7.

Turning now to FIG. 15, the pliable sheet wall 64 includes a pliable sheet panel 160. The pliable sheet panel 160 is made of a pliable material such that, when the pliable sheet panel 160 is not stretched and secured to the frame 62, the pliable sheet panel 160 can be folded by hand without undue force. In other words, no tooling is necessary to bend the material of the pliable sheet panel 160. In particular, in this embodiment, the pliable sheet panel 160 is made of fabric. With more specificity, in this embodiment, the pliable sheet panel 160 is made of woven polyester. Other types of fabrics are contemplated for use as the material of the pliable sheet panel 160. Moreover, it is contemplated that, in other embodiments, the pliable sheet panel 160 could be made of a different pliable material. For instance, in some embodiments, the pliable sheet panel 160 is made of a polymeric material such as polyvinyl chloride (PVC). Notably, the pliable sheet panels 160 of certain other portions 54, 58, 60 of the barrier structure 50 could be made of polymeric material.

Figure 16:
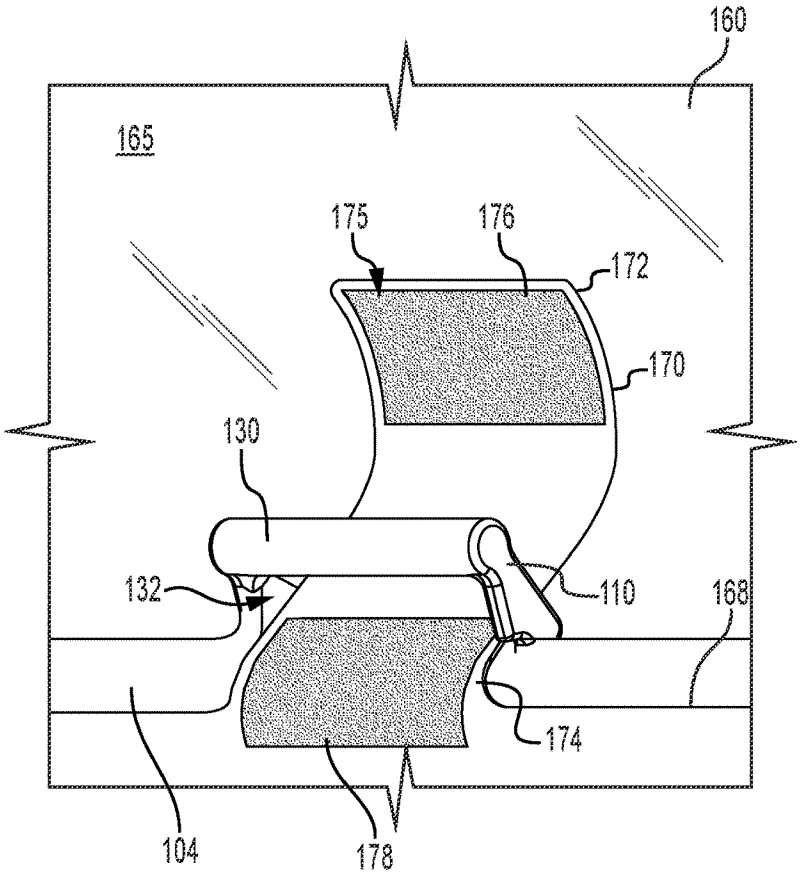
FIG. 16 is a perspective view of a lower anchor and an attachment portion of the pliable sheet wall of FIG. 15, showing the attachment portion in an unsecured state.

As shown in FIG. 15, the pliable sheet panel 160 has a front edge 162, a rear edge 164, an upper edge 166 and a lower edge 168. The pliable sheet panel 160 is shaped to fit the frame 62. In this embodiment, a lower portion of the pliable sheet panel 160 has an elastic strip 145 which can help keep the tension in the pliable sheet panel 160 when the pliable sheet panel 160 is installed on the frame 62. The elastic strip 145 may be omitted in other embodiments. A plurality of attachment portions 170 are provided along the lower edge 168 of the pliable sheet panel 160 for connecting the lower edge 168 to the lower portion 72 of the frame 62. Notably, in this embodiment, the attachment portions 170 are straps which are sewn to the lower edge 168 of the pliable sheet panel 160. The straps 170 may be connected to the pliable sheet panel 160 otherwise in other embodiments. As shown in FIG. 16, each strap 170 has a distal end 172 and a proximal end 174 (the distal end 172 being the end that is most distant from the lower edge 168 of the pliable sheet panel 160). The strap 170 has a hook-and-loop fastener 175, namely including a hook portion 176 and a loop portion 178. In particular, the hook portion 176 is disposed at the distal end 172 while the loop portion 178 is disposed at the proximal end 174. It is contemplated that, in some embodiments, various elastic strips 145 may be provided aligned with each strap 170 instead of a single one extending along the entire length of the pliable sheet panel 160, each elastic strip 145 being sized to the width of a corresponding strap 170.

In order to connect the lower edge 168 of the pliable sheet panel 160 to the lower portion 72 of the frame 62, the lower edge 168 of the pliable sheet panel 160 is wrapped around a corresponding lower railing member 104 such that part of an inner surface 165 of the pliable sheet panel 160 covers in part the lower railing member 104. Then, as shown in FIG. 16, each strap 170 is inserted through the opening 132 defined by a corresponding lower anchor 110 and then taughtly wrapped around the bar 130 thereof to bring the distal and proximal ends 172, 174 of the strap 170 together so as to mate the hook and loop portions 176, 178 to one another. This manner of attaching the lower edge 168 of the pliable sheet panel 160 to the lower portion 72 of the frame 62 is easy to perform and also allows readjusting the pliable sheet panel 160 if needed, notably to provide tension in the pliable sheet panel 160 and accommodate for variations in the size and/or shape of the pliable sheet panel 160 and/or the frame 62.

While in this embodiment the attachment portions 170 use hook-and-loop fasteners 175 to secure the lower edge 168 to the lower portion 72 of the frame 62, it is contemplated that the attachment portions 170 could be configured differently in other embodiments. For instance, in other embodiments, rather than hook-and-loop fasteners, the attachment portions 170 could have snaps, zippers, or other types of securing devices.

Figure 19:
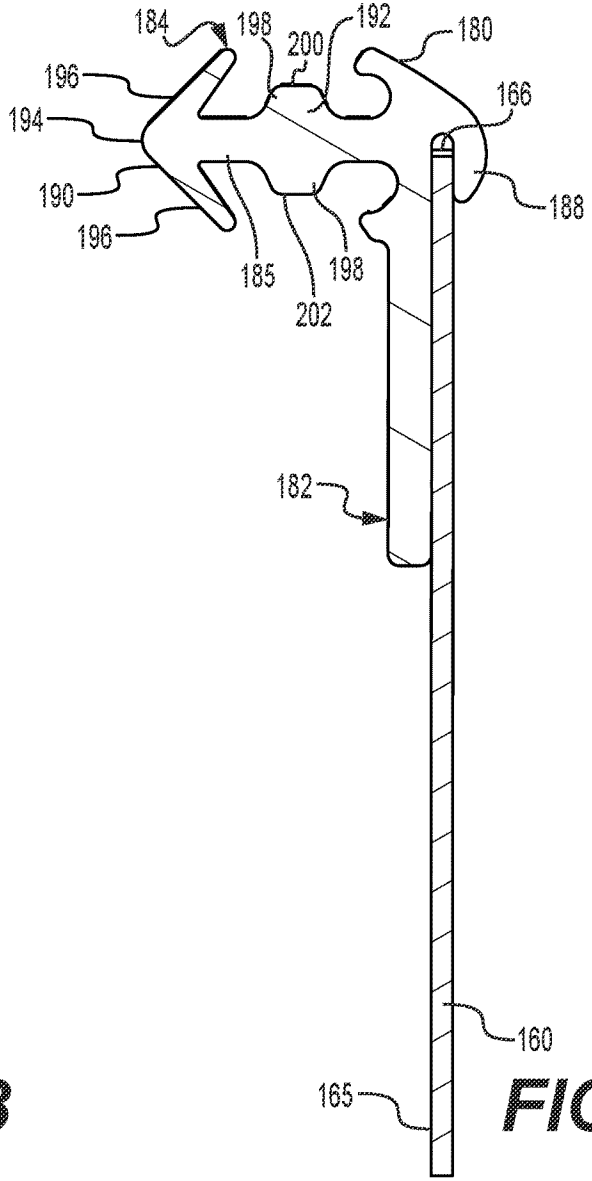
FIG. 19 is a cross-sectional view of part of the pliable sheet wall of the left lateral portion of the barrier structure FIG. 7, showing the anchor and an upper portion of the pliable sheet panel of the pliable sheet wall.

With reference to FIGS. 7 and 19, the pliable sheet wall 64 also includes a plurality of anchors 180 each extending partially along the upper edge 166 of the pliable sheet panel 160. The anchors 180 connect the pliable sheet panel 160 to the upper portion 70 of the frame 62. Although the anchors 180 may have different lengths, in this embodiment each anchor 180 has an identical cross-sectional profile. Therefore, only one of the anchors 180 will be described herein with respect to FIG. 18. It is understood that the same description applies to the other anchors 180. It is contemplated that a single anchor 180 could be provided along substantially the entire length of the upper edge 166.

Figure 18:
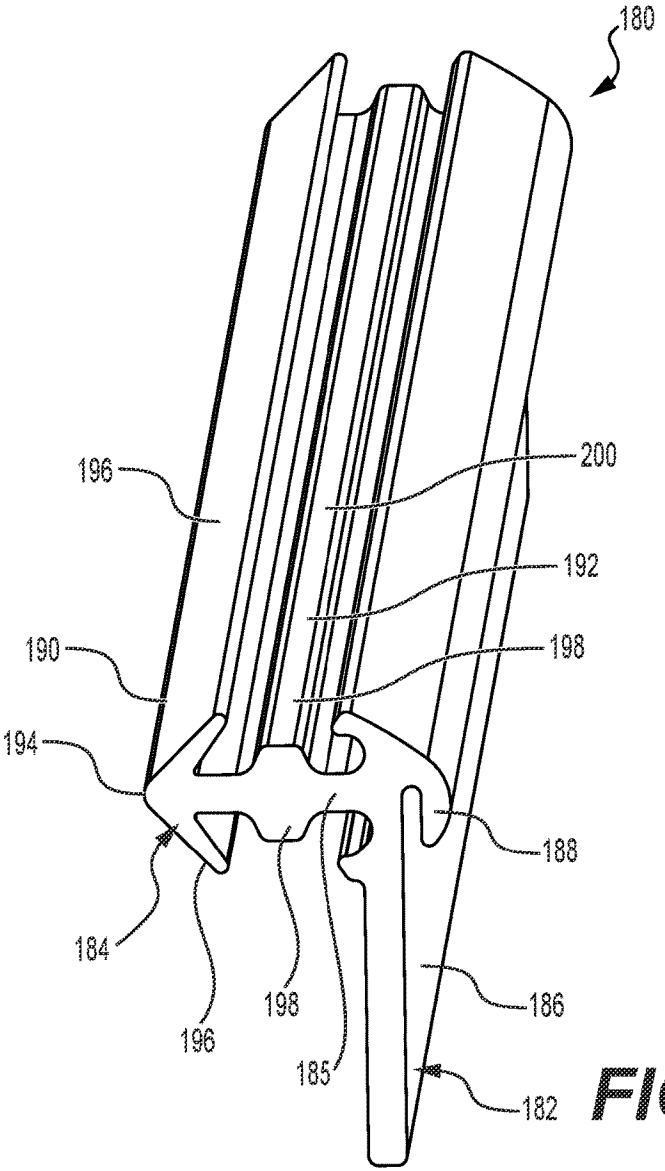
FIG. 18 is a perspective view, taken from a front, left side, of an anchor of the pliable sheet wall of the left lateral portion of FIG. 7.

As shown in FIG. 18, the anchor 180 includes a base 182 and an interlocking member 184 extending from the base 182. The base 182 is connected to the upper edge 166 of a corresponding pliable sheet panel 160. In particular, the base 182 receives the upper edge 166 of the pliable sheet panel 160 in a slot defined between two vertical legs 186, 188 that are parallel and spaced apart from one another. As shown in FIG. 19, the slot defined between the legs 186, 188 is dimensioned to snugly fit the upper edge 166 of the pliable sheet panel 160 therein. The inner leg 186 has a greater length than the outer leg 188. In this embodiment, the inner leg 186 is sewn to an upper portion of the pliable sheet panel 160 proximate the upper edge 166 of the pliable sheet panel 160. It is contemplated that the upper edge 166 may be sewn to the outer leg 188 instead of, or in addition to, the inner leg 186.

Figure 20:
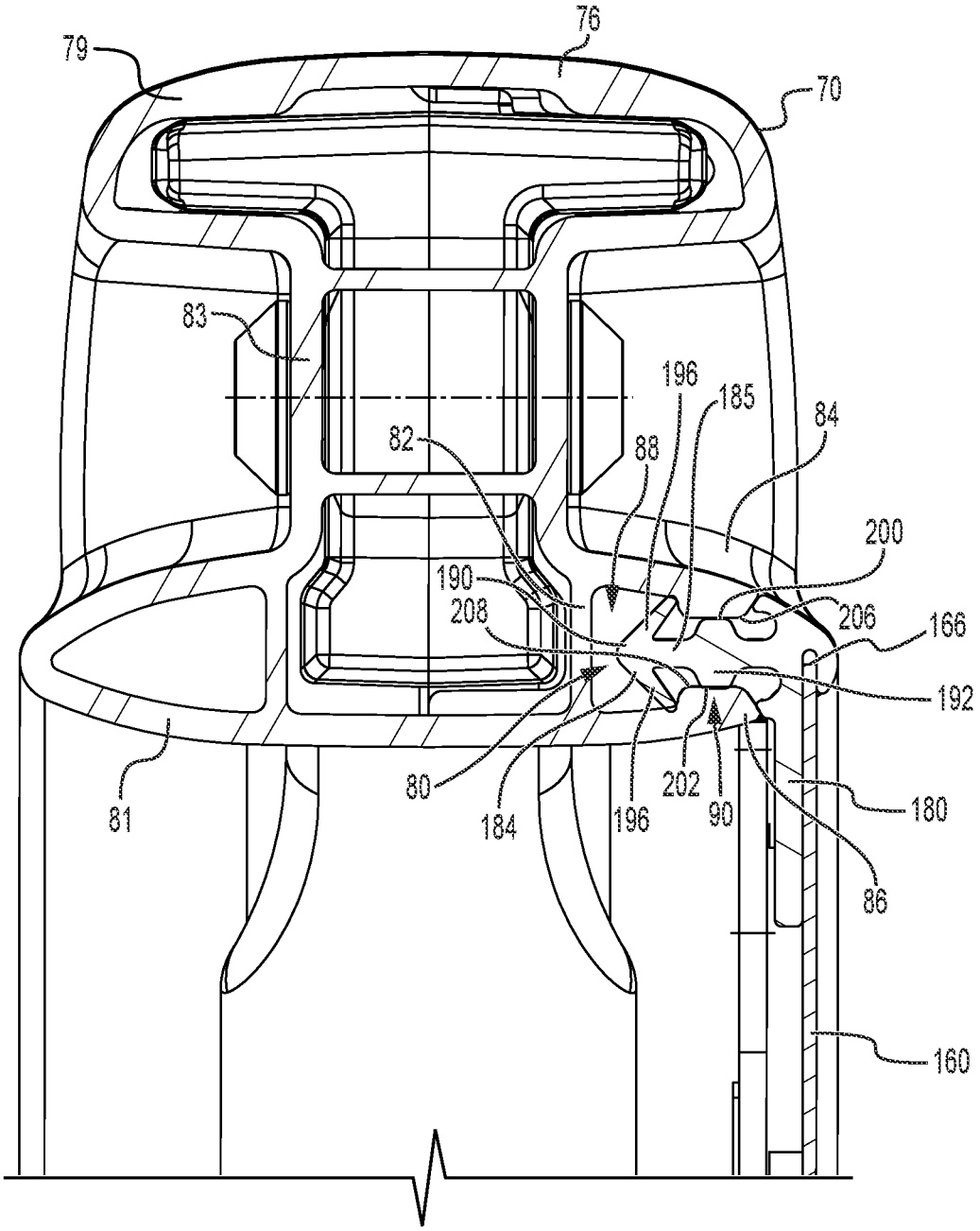
FIG. 20 is a cross-sectional view of part of the left lateral portion of the barrier structure of FIG. 7, showing one of the anchors and one of the rail members thereof engaged to one another.

The interlocking member 184 is configured to be received in the channel 80 of a corresponding rail member 76 so as to connect the upper edge 166 of the pliable sheet panel 160 thereto. As shown in FIG. 18, the interlocking member 184 includes a stem 185 as well as an engaging portion 190 and a restricting portion 192 formed on the stem 185. In this embodiment, the stem 185 extends generally perpendicularly from the base 182. The engaging portion 190 is disposed at an end of the stem 185 (furthest from the base 182) such that the engaging portion 190 is further from the base 182 than the restricting portion 192. In a cross-sectional profile of the interlocking member 182, the engaging portion 190 is generally V-shaped. Notably, in the cross-sectional profile of the interlocking member 184, the engaging portion 190 has a tip 194 and two side arms 196 converging at the tip 194. The tip 194 defines the point of the interlocking member 184 that is furthest from the base 182. The tip 194 is centered with respect to the stem 185 while the side arms 196 are generally symmetrical to one another about an axis of the stem 185. As can be seen in FIG. 20, in a cross-section of the barrier structure 50 taken perpendicular to the pliable sheet panel 160, the interlocking member 184 extends from the anchor 180 such that the tip 194 points in a direction generally perpendicular to the plane of the pliable sheet panel 160.

The restricting portion 192 of the interlocking member 184 includes two projections 198 extending from a respective side of the stem 185. The projection 198 extending from the upper side of the stem 185 defines an upper flat surface 200 while the projection 198 extending from the lower side of the stem 185 defines a lower flat surface 202 opposite the upper flat surface 200. The restricting portion 192 is generally symmetrical about the axis of the stem 185.

In this embodiment, the anchor 180 is made of an elastomeric material so as to provide flexibility to the anchor 180. Notably, in this instance, the anchor 180 is made of rubber. This can allow the arms 196 of the interlocking member 184 to deflect upon entering the channel 80, as will be described in more detail below.

With reference to FIG. 20, in order to connect the upper edge 166 of the pliable sheet panel 160 to the rail members 76, the interlocking member 184 of the anchor 180 is inserted into the channel 80. More specifically, the interlocking member 184 of the anchor 180 is inserted into the channel 80 such that the tip 194 first enters into the constricted section 90 (i.e., the portion of the channel 80 defined between the end portions of the opposite channel walls 84, 86) before entering the enlarged section 88 of the channel 80. As the span of the side arms 196 is greater than the spacing defined between opposite surfaces 206, 208 (FIG. 10B) defined by the end portions of the channel walls 84, 86, the side arms 196 flex as they enter the constricted section 90. Once the ends of the side arms 196 are past the constricted section 90 and enter the enlarged section 88 of the channel 80, the side arms 196 spring back to their original position. Once the engaging portion 190 has been inserted into the enlarged section 88, the restricting portion 192 is disposed in the constricted section 90 of the channel 80.

Once the engaging portion 190 has been inserted into the enlarged section 88 of the channel 80 and the side arms 196 have thus sprung back to their original position, a significant force is required to pull the interlocking member 184 from the channel 80. Notably, when the engaging portion 190 is disposed in the enlarged section 88 of the channel 80, respective shoulders 210 (FIG. 10B) formed by the channel walls 84, 86 abut the ends of the side arms 196 when the interlocking member 184 is pulled from the channel 80 (in the opposite direction in which it was inserted) so that the side arms 196 resist being pulled through the constricted section 90 of the channel 80. At the same time, the restricting portion 192 is sized and shaped to limit rotation of the interlocking member 184 within the constricted section 90 of the channel 80. In particular, the upper and lower flat surfaces 200, 202 are in a snug fit against the surfaces 206, 208 of the channel walls 84, 86 respectively.

As will be understood, when connecting the pliable sheet wall 64 to the frame 62, the anchors 180 are first attached to the upper portion 70 of the frame 62 before attaching the straps 170 to the lower portion 72 of the frame 62.

Figure 25:
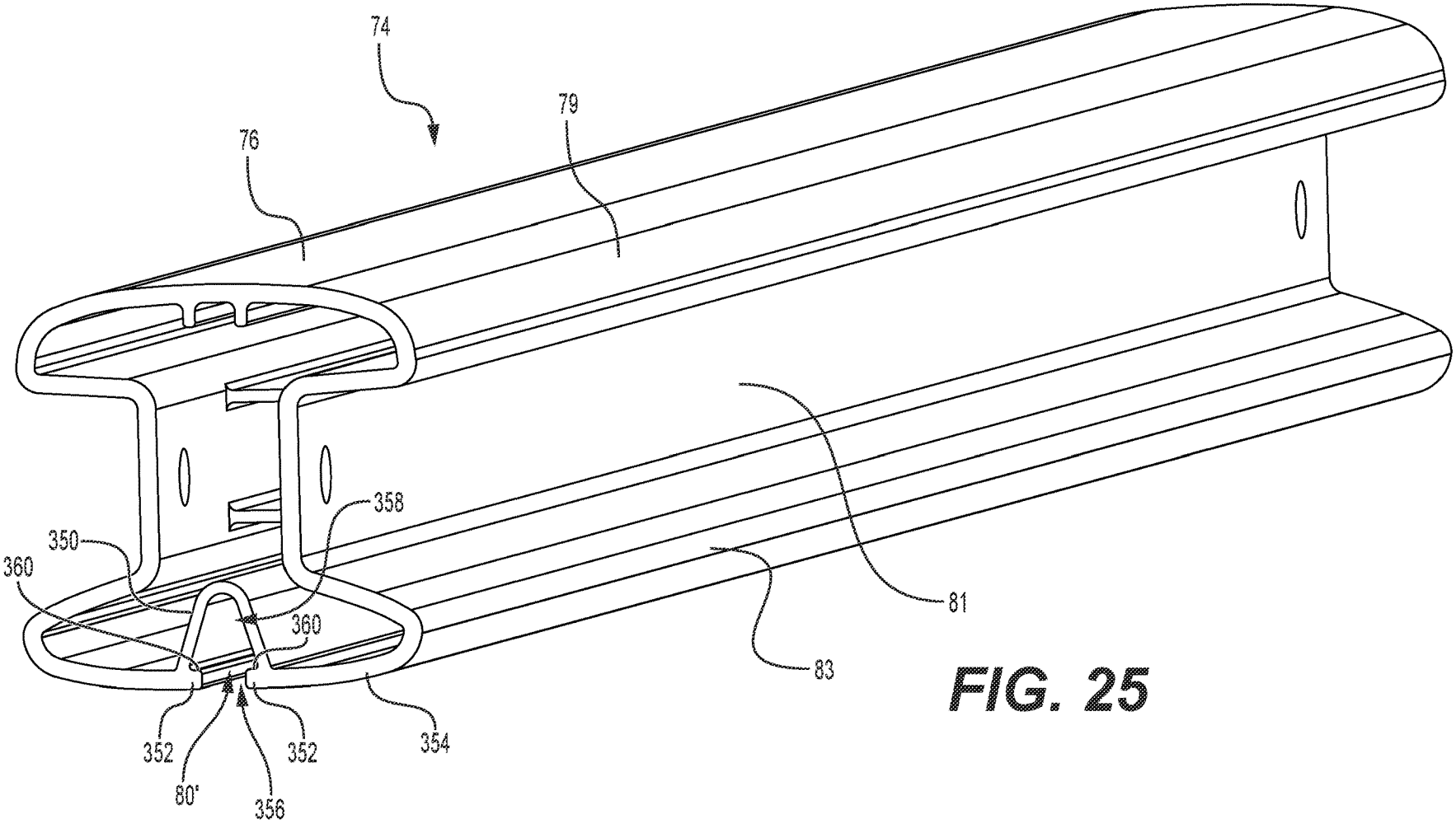
FIG. 25 is a perspective view, taken from a top, front, left side, of a rail member of the left lateral portion of the barrier structure in accordance with another embodiment.

The channels 80 of the rail members 76 and the anchors 180 of the pliable sheet walls 64 may be configured otherwise in other embodiments. Notably, with reference now to FIGS. 25 to 27, another embodiment of anchors 180' and channels 80' is shown. As shown in FIG. 25, in this embodiment, the channel 80' of each rail member 76, defined by an interior wall 350 of the wide lower portion 83 of the rail member 76 on a lower side thereof such that the channel 80' extend along a lower side of the rail member 76 and thus of the rail 74. The channel 80' has a generally triangular shape in a cross-sectional profile of the rail 74. Two lower ends 352 formed by the lower wall 354 of the lower portion 83 of the rail member 76 define a constricted section 356 of the channel 80'. Notably, the channel 80' widens past the constricted section 356 into an enlarged section 358.

Figure 26:
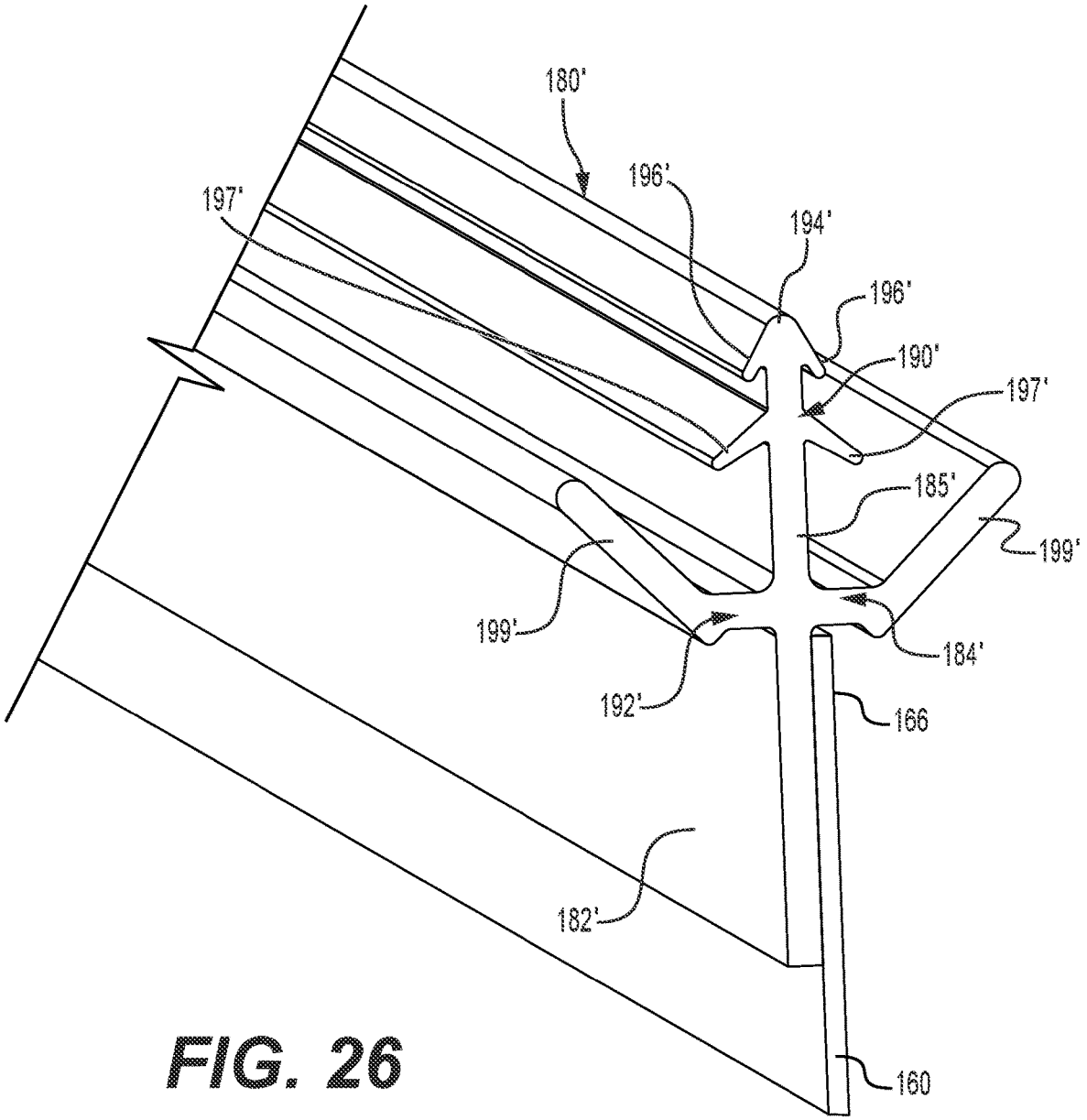
FIG. 26 is a perspective view, taken from a front, left side, of part of an anchor of the pliable sheet wall according to another embodiment, corresponding to the rail member of FIG. 25.
Figure 27:
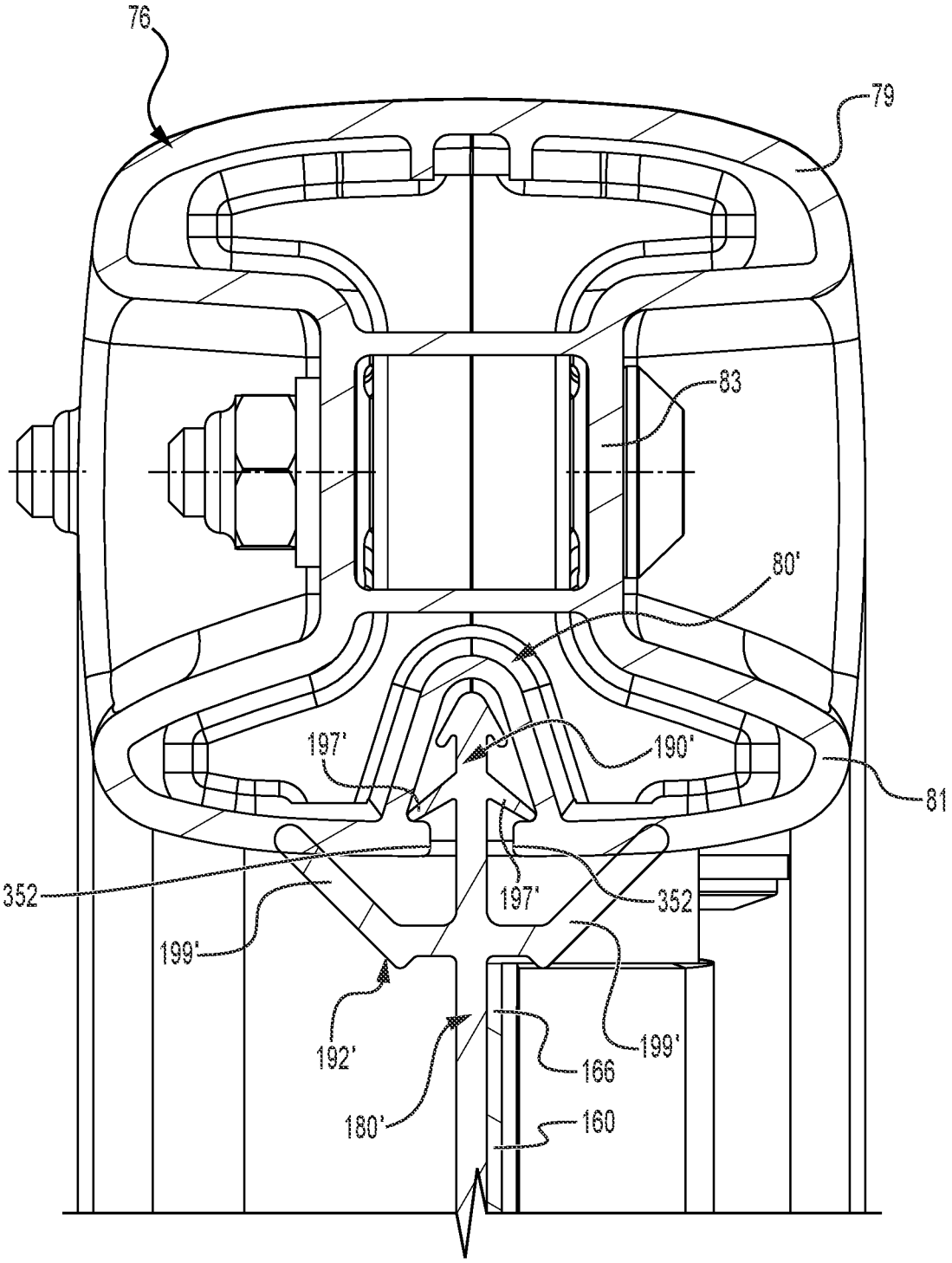
FIG. 27 is a cross-sectional view of part of the frame of the left lateral portion of the barrier structure in accordance with the embodiment of FIGS. 25 and 26, showing one of the anchors and one of the rail members thereof engaged to one another.

Continuing now to FIG. 26, each of the anchors 180' includes a base 182' and an interlocking member 184' extending from the base 182'. The base 182' is connected to the upper edge 166 of a corresponding pliable sheet panel 160. Notably, in this embodiment, the base 182' is sewn to the upper edge 166 of the pliable sheet panel 160. The interlocking member 184' is configured to be received in the channel 80' of a corresponding rail member 76 so as to connect the upper edge 166 of the pliable sheet panel 160 thereto. The interlocking member 184' includes a stem 185' as well as an engaging portion 190' and a restricting portion 192' formed on the stem 185. In this embodiment, the stem 185' extends generally parallel to the base 182. The engaging portion 190' is further from the base 182' than the restricting portion 192'. The engaging portion 190' has an end portion that is V-shaped, including a tip 194' and two side arms 196' converging at the tip 194'. The tip 194 defines the point of the interlocking member 184' that is furthest from the base 182'. The tip 194' is centered with respect to the stem 185' while the side arms 196' are generally symmetrical to one another about an axis of the stem 185'. The engaging portion 190' also includes two additional side arms 197' that converge at the stem 185' and extend toward the base 182'. The side arms 197' extend wider than the side arms 196'. The restricting portion 192' includes two side arms 199' that converge at the stem 185', are symmetrical to one another about the axis of the stem 185' and which extend toward the tip 194'. As can be seen in FIG. 27, in a cross-section of the barrier structure 50 taken perpendicular to the pliable sheet panel 160, the interlocking member 184' extends from the anchor 180' such that the tip 194' points in a direction generally parallel to the pliable sheet panel 160.

Thus, as shown in FIG. 27, in this alternative embodiment, the anchors 180' are inserted into the corresponding channels 80' from the lower side of the rail members 76, vertically into the channels 80'. The side arms 199' of the restricting portion 192' restrict rotation of the interlocking member 184' relative to the rail member 76 while the side arms 197' abut internal shoulders 360 formed by the ends 352 (see FIG. 25) to resist retraction of the interlocking member 184' from the channel 80'.

In some embodiments, the positions of the channel 80 (or the channel 80') and the interlocking member 184 (or the interlocking member 184') may be reversed. Notably, the rail members 76 could instead each be provided with an interlocking member such as the interlocking member 184 or 184' while the anchors 180 or 180' could be provided with a channel such as the channel 80 or 80'.

Furthermore, it is contemplated that, in some embodiments, the positions of the attachment portions 170 and the anchors 180 or 180' may be reversed. Notably, the attachment portions 170 could be provided along the upper edge 166 of the pliable sheet panel 160 and the anchors 180 or 180' could be provided along the lower edge 168 of the pliable sheet panel 160. In such embodiments, the corresponding receiving structures of the upper and lower portions 70, 72 of the frame 62 would also be reversed (i.e., the lower anchors 110 would be provided at the upper portion 70 of the frame 62 and the channel 80 or 80' would be provided at the lower portion 72 of the frame 62).

The above description of the left and right lateral portions 56 of the barrier structure 50 also applies to other portions of the barrier structure 50. Notably, the front end portion 54 and the rear end portion 60 of the barrier structure 50 have the same configuration, namely each including respective a respective frame 62 including upper and lower portions 70, 72, as well as a pliable sheet wall 64 connected to the frame 62. The front end portion 54 is hinged about the front end member 73 of the right lateral portion 76 so that the front end portion 54 functions as a door to permit ingress and egress into and from the boat 10. The corner portions 58 of the barrier structure 50 are also hinged to function as doors to permit ingress and egress into and from the boat 10.

The above-described configuration of the barrier structure 50 of the boat 10 is easy to install and relatively inexpensive to produce. Notably, the components of the frames 62 of the various portions 54, 56, 58, 60 of the barrier structure 50 are easily interconnected to one another and connected to the hull 32. The use of pliable sheet panels for the walls 64 reduces production costs compared to conventional wall structures in boats such as rigid sheet metal panels or fiberglass sections. In addition, the pliable sheet walls 64 are easy to attach to the frames 62 via the anchors 180 and the attachment portions 170 thereof which also reduces the production cost of the boat 10. It will also be appreciated that embodiments of the above-described technology can provide an adjustability, such as by providing the elastic strip 145 and/or the straps 170, that allows more generous tolerances in manufacturing and assembling the remainder of the structure, which can thereby further reduce the production cost of the boat 10.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft, comprising:
a deck;
a hull supporting the deck; and
a barrier structure comprising:
a frame connected to at least one of the deck and the hull and at least partially surrounding a portion of the deck, the frame comprising:
an upper portion including a rail for grabbing by a user's hand; and
a lower portion connected to the at least one of the deck and the hull, the lower portion and the upper portion being connected to one another; and
a pliable sheet wall connected to the frame, the pliable sheet wall being stretched across at least a portion of the frame so as to extend between the upper and lower portions of the frame, the pliable sheet wall being placed in tension between the upper and lower portions.

2. The watercraft of claim 1, wherein the pliable sheet wall comprises:
at least one pliable sheet panel having an upper edge and a lower edge; and
an anchor extending at least partially along one of the upper edge and the lower edge of the at least one pliable sheet panel, the anchor connecting the at least one pliable sheet panel to a corresponding one of the upper and lower portions of the frame.

3. The watercraft of claim 2, wherein:
the one of the upper edge and the lower edge is the upper edge; and
the anchor connects the at least one pliable sheet panel to the upper portion of the frame.

4. The watercraft of claim 2, wherein:
one of the frame and the anchor defines a channel; and
an other one of the frame and the anchor comprises an interlocking member that is at least partially received in the channel so as to connect the one of the upper edge and the lower edge of the at least one pliable sheet panel to the frame.

5. The watercraft of claim 4, wherein the one of the frame and the anchor is the frame such that the frame defines the channel and the anchor comprises the interlocking member.

6. The watercraft of claim 5, wherein the rail of the frame defines the channel.

7. The watercraft of claim 2, wherein the pliable sheet wall further comprises at least one attachment portion disposed along an other one of the upper edge and the lower edge of the at least one pliable sheet panel, the at least one attachment portion connecting the other one of the upper edge and the lower edge of the at least one pliable sheet panel to a corresponding one of the upper and lower portions of the frame.

8. The watercraft of claim 7, wherein the at least one attachment portion includes a hook-and-loop fastener.

9. The watercraft of claim 4, wherein:
the one of the frame and the anchor comprises:
a first channel wall;
a second channel wall opposite the first channel wall; and
a third channel wall extending between the first and second channel walls,
the channel being defined between the first, second and third channel walls;
the channel has an enlarged section and a constricted section, whereby a spacing between the first and second channel walls is greater at the enlarged section than at the constricted section;
the enlarged section of the channel is closer to the third channel wall than the constricted section; and
the interlocking member comprises:
an engaging portion that is inserted into the enlarged section of the channel; and
a restricting portion that is disposed in the constricted section of the channel, the restricting portion being sized and shaped to limit rotation of the interlocking member within the constricted section of the channel.

10. The watercraft of claim 6, wherein the channel extends along a laterally-outward side of the rail.

11. The watercraft of claim 2, wherein at least one of the at least one pliable sheet panel is made of fabric.

12. The watercraft of claim 2, wherein the anchor is made of an elastomeric material.

13. The watercraft of claim 2, wherein the lower portion of the frame comprises:
at least one lower railing extending generally parallel to an upper surface of the deck; and
at least one lower frame connector connected between the at least one lower railing and the hull, the at least one lower frame connector extending downwardly from the at least one lower railing.

14. The watercraft of claim 7, wherein the lower portion of the frame comprises:
at least one lower railing extending generally parallel to an upper surface of the deck, the at least one lower railing defining an anchor mounting channel; and
at least one lower anchor interlocked with the at least one lower railing via the anchor mounting channel,
the at least one attachment portion of the pliable sheet wall being secured to the at least one lower anchor.

15. A barrier structure for a watercraft, comprising:

a frame configured to be connected to at least one of a deck and a hull of the watercraft and configured to at least partially surround a portion of the deck, the frame comprising:

an upper portion including a rail for grabbing by a user's hand; and a lower portion configured to be connected to the at least one of the deck and the hull of the watercraft, the lower portion and the upper portion being connected to one another;

and a pliable sheet wall connected to the frame, the pliable sheet wall being stretched across at least a portion of the frame and so as to extend between the upper and lower portions of the frame, the pliable sheet wall being placed in tension between the upper and lower portions.

16. The barrier structure of claim 15, wherein the pliable sheet wall comprises:

at least one pliable sheet panel having an upper edge and a lower edge; and an anchor extending at least partially along one of the upper edge and the lower edge of the at least one pliable sheet panel, the anchor connecting the at least one pliable sheet panel to a corresponding one of the upper and lower portions of the frame.

17. The barrier structure of claim 16, wherein:

the one of the upper edge and the lower edge is the upper edge; and the anchor connects the at least one pliable sheet panel to the upper portion of the frame.

18. The barrier structure of claim 16, wherein:

one of the frame and the anchor defines a channel; and an other one of the frame and the anchor comprises an interlocking member that is at least partially received in the channel so as to connect the one of the upper edge and the lower edge of the at least one pliable sheet panel to the frame.

19. The barrier structure of claim 16, wherein the pliable sheet wall further comprises at least one attachment portion disposed along an other one of the upper edge and the lower edge of the at least one pliable sheet panel, the attachment portion connecting the other one of the upper edge and the lower edge of the at least one pliable sheet panel to a corresponding one of the upper and lower portions of the frame.

20. The barrier structure of claim 16, wherein at least one of the at least one pliable sheet panel is made of fabric.

* * * * *